US011641990B2

(12) United States Patent
Burbank et al.

(10) Patent No.: US 11,641,990 B2
(45) Date of Patent: May 9, 2023

(54) DEBRIS BINS AND MOBILE CLEANING ROBOTS INCLUDING SAME

(71) Applicant: iRobot Corporation, Bedford, MA (US)

(72) Inventors: Eric Burbank, Lexington, MA (US); Christopher Robin Grace, Windham, NH (US); Oliver Majer Lewis, Waltham, MA (US); Stephen Albert Hickey, Somerville, MA (US); Jude Royston Jonas, Hudson, NH (US)

(73) Assignee: iRobot Corporation, Bedford, MA (US)

( * ) Notice: Subject to any disclaimer, the term of this patent is extended or adjusted under 35 U.S.C. 154(b) by 388 days.

(21) Appl. No.: 17/019,924

(22) Filed: Sep. 14, 2020

(65) Prior Publication Data

US 2020/0405106 A1 Dec. 31, 2020

Related U.S. Application Data

(63) Continuation of application No. 16/039,070, filed on Jul. 18, 2018, now Pat. No. 10,779,695.

(Continued)

(51) Int. Cl.

*A47L 9/12* (2006.01)
*A47L 9/14* (2006.01)

(Continued)

(52) U.S. Cl.

CPC ..... *A47L 9/122* (2013.01); *A47L 9/102* (2013.01); *A47L 9/1409* (2013.01);

(Continued)

(58) Field of Classification Search

CPC ..... A47L 9/32; A47L 9/122; A47L 9/102; A47L 9/1409; A47L 9/1472; A47L 9/1481; A47L 2201/00; A47L 2201/04

See application file for complete search history.

(56) References Cited

U.S. PATENT DOCUMENTS 8,528,157 B2 9/2013 Schnittman et al.
8,572,799 B2 11/2013 Won et al.

(Continued)

FOREIGN PATENT DOCUMENTS

CN 206365853 8/2017
CN 107307798 11/2017

(Continued)

OTHER PUBLICATIONS

"Chinese Application Serial No. 201811535693.9, Response filed Sep. 9, 2021 to Office Action dated May 7, 2021", w English Claims, 18 pgs.

(Continued)

*Primary Examiner* — Marc Carlson

(74) *Attorney, Agent, or Firm* — Schwegman Lundberg & Woessner, P.A.

(57) ABSTRACT

A mobile cleaning robot includes a removable filter unit configured to receive a supply airflow generated by a blower and to filter debris from the supply airflow, a filter seat, a filter access opening, a filter access door, and a filter presence system. The filter access door is pivotable between a closed position, wherein the filter access door covers the filter access opening, and an open position, wherein the filter access door is displaced from the filter access opening to permit access to the filter seat. The filter presence system is configured to: permit the filter access door to move from the open position into the closed position when the filter unit is disposed in the filter seat; and prevent the filter access door from being moved into the closed position when the filter unit is not disposed in the filter seat. The filter presence system includes a lift arm movable between an extended position and a retracted position. When the filter access door is open, the lift arm assumes the extended position to receive the filter unit in the filter seat. Moving the filter access door (Continued)

from the open position into the closed position when the filter unit is disposed in the filter seat causes the lift arm to move to the retracted position.

20 Claims, 15 Drawing Sheets

Related U.S. Application Data

(60) Provisional application No. 62/611,986, filed on Dec. 29, 2017.

(51) Int. Cl.
*A47L 9/10* (2006.01)
*A47L 9/32* (2006.01)

(52) U.S. Cl.
CPC ..... *A47L 9/1472* (2013.01); *A47L 9/1481* (2013.01); *A47L 9/32* (2013.01); *A47L 2201/00* (2013.01); *A47L 2201/04* (2013.01)

(56) References Cited

U.S. PATENT DOCUMENTS

| | | | | |
|---|---|---|---|---|
| 8,741,013 | B2 * | 6/2014 | Swett | A47L 9/22 55/482 |
| 8,881,339 | B2 * | 11/2014 | Gilbert, Jr. | A47L 11/4063 15/384 |
| 8,910,342 | B2 | 12/2014 | Gilbert, Jr. et al. | |
| 8,955,192 | B2 | 2/2015 | Gilbert, Jr. et al. | |
| 9,220,386 | B2 | 12/2015 | Gilbert, Jr. et al. | |
| 9,320,398 | B2 | 4/2016 | Hussey et al. | |
| 9,320,400 | B2 | 4/2016 | Gilbert, Jr. et al. | |
| 9,462,920 | B1 | 10/2016 | Morin et al. | |
| 9,492,048 | B2 | 11/2016 | Won et al. | |
| 9,675,224 | B2 | 6/2017 | Gilbert, Jr. et al. | |
| 9,924,846 | B2 | 3/2018 | Morin et al. | |
| 9,955,841 | B2 | 5/2018 | Won et al. | |
| 10,154,768 | B2 | 12/2018 | Morin et al. | |
| 10,779,695 | B2 | 9/2020 | Burbank et al. | |
| 2005/0000195 | A1 | 1/2005 | Bott et al. | |
| 2009/0044370 | A1 * | 2/2009 | Won | A47L 11/4008 15/319 |
| 2010/0107355 | A1 | 5/2010 | Won et al. | |
| 2012/0023699 | A1 * | 2/2012 | Shim | A47L 9/00 15/319 |
| 2012/0084937 | A1 | 4/2012 | Won et al. | |
| 2012/0199006 | A1 * | 8/2012 | Swett | A47L 9/22 96/417 |
| 2012/0222262 | A1 * | 9/2012 | Conrad | A47L 9/00 55/391 |
| 2019/0999767 | | 9/2012 | Conrad | |
| 2012/0273282 | A1 | 11/2012 | Lin et al. | |
| 2013/0061416 | A1 * | 3/2013 | Dyson | A47L 9/009 15/319 |
| 2013/0298350 | A1 | 11/2013 | Schnittman et al. | |
| 2015/0059119 | A1 * | 3/2015 | Yato | A47L 9/2868 15/339 |
| 2015/0134179 | A1 | 5/2015 | Murakami et al. | |
| 2016/0058256 | A1 * | 3/2016 | Ju | A47L 9/0488 15/347 |
| 2016/0073846 | A1 | 3/2016 | Gilbert, Jr. et al. | |
| 2016/0095487 | A1 | 4/2016 | Koura et al. | |
| 2016/0236343 | A1 * | 8/2016 | Neumann | A47L 9/32 |
| 2017/0020355 | A1 * | 1/2017 | Wennerström | A47L 11/4027 |
| 2017/0055796 | A1 | 3/2017 | Won et al. | |
| 2017/0071434 | A1 * | 3/2017 | Nguyen | A47L 11/4013 |
| 2017/0238780 | A1 | 8/2017 | Gilbert, Jr. et al. | |
| 2017/0325647 | A1 * | 11/2017 | Kwak | A47L 9/28 |
| 2018/0116478 | A1 * | 5/2018 | Lewis | A47L 9/102 |
| 2018/0177367 | A1 * | 6/2018 | Amaral | A47L 9/102 |
| 2018/0199785 | A1 * | 7/2018 | Farmer | A47L 9/068 |
| 2018/0206686 | A1 * | 7/2018 | Shigeto | A47L 9/0477 |
| 2019/0059674 | A1 * | 2/2019 | Koura | A47L 9/2831 |
| 2019/0142233 | A1 * | 5/2019 | Swett | A47L 9/1409 15/347 |
| 2019/0200826 | A1 * | 7/2019 | Burbank | A47L 9/102 |
| 2020/0015646 | A1 * | 1/2020 | Gilbert, Jr. | A47L 9/0477 |
| 2020/0214525 | A1 * | 7/2020 | Lu | A47L 11/4013 |

FOREIGN PATENT DOCUMENTS

| | | | | |
|---|---|---|---|---|
| CN | 109984681 | | 7/2019 | |
| CN | 209377471 | | 9/2019 | |
| CN | 209489964 | | 10/2019 | |
| CN | 209489965 | | 10/2019 | |
| CN | 209489966 | | 10/2019 | |
| DE | 202005015042 | | 2/2007 | |
| DE | 202013103666 | | 11/2013 | |
| EP | 1940277 | | 7/2008 | |
| EP | 2923624 | | 9/2015 | |
| EP | 3505035 | | 7/2019 | |
| GB | 2436447 | | 9/2007 | |
| JP | 2002078652 | | 3/2002 | |
| JP | 2017213009 | | 12/2017 | |
| JP | 2017213009 | A * | 12/2017 | A47L 9/00 |
| JP | 7102330 | B2 | 7/2022 | |
| WO | 03053205 | | 7/2003 | |
| WO | 2012149572 | | 11/2012 | |
| WO | WO-2012149572 | A2 * | 11/2012 | A47L 11/24 |
| WO | 2013105431 | | 7/2013 | |

OTHER PUBLICATIONS

"European Application Serial No. 21186430.1, Extended European Search Report dated Nov. 15, 2021", 8 pgs.
"Chinese Application Serial No. 201811535693.9, Office Action dated May 7, 2021", w English Translation, 10 pgs.
"European Application Serial No. 18212707.6, Communication Pursuant to Article 94(3) EPC dated Jun. 19, 2019", 6 pgs.
"European Application Serial No. 18212707.6, Extended European Search Report dated Jun. 5, 2019", 5 pgs.
"Chinese Application Serial No. 201822109635.1, Response filed Aug. 19, 2019 to Notification to Make Rectification dated Aug. 14, 2019", w current English claims, claims not amended in response filed, 75 pgs.
"U.S. Appl. No. 15/815,099, filed Nov. 16, 2017".
"U.S. Appl. No. 16/184,450, filed Nov. 8, 2018".
"Milagrow AguaBot 5 0 India's 1st Full Wet Mopping and Dry Cleaning Floor Vacuuming Robot Fact Sheet (Downloaded on Aug. 26, 2016)", (accessed on Aug. 26, 2016), 19 pgs.
"European Application Serial No. 18212707.6, Response filed Dec. 18, 2019 to Communication Pursuant to Article 94(3) EPC dated Jun. 19, 2019", 15 pgs.
"U.S. Appl. No. 16/039,070, Non Final Office Action dated Apr. 30, 2020", 11 pgs.
"U.S. Appl. No. 16/039,070, Response filed Jul. 30, 2020 to Non Final Office Action dated Apr. 30, 2020", 8 pgs.
"U.S. Appl. No. 16/039,070, Notice of Allowance dated Aug. 7, 2020", 8 pgs.
"Japanese Application Serial No. 2018-240868, Notification of Reasons for Refusal dated Feb. 14, 2022", w English Translation, 5 pgs.
U.S. Appl. No. 16/039,070, U.S. Pat. No. 10,779,695, filed Jul. 18, 2018, Debris Bins and Mobile Cleaning Robots Including Same.

* cited by examiner

DEBRIS BINS AND MOBILE CLEANING ROBOTS INCLUDING SAME

RELATED APPLICATION(S)

The present application claims the benefit of and priority from U.S. Provisional Patent Application No. 62/611,986, filed Dec. 29, 2017, the disclosure of which is incorporated herein by reference in its entirety.

TECHNICAL FIELD

This specification relates to bins for a mobile cleaning robots and mobile cleaning robots and methods including bins.

BACKGROUND

A mobile cleaning robot can navigate over a surface such as a floor and clean debris from the surface. Once collected, the debris can be stored in a volume inside the robot and later removed.

SUMMARY

According to some embodiments, a mobile cleaning robot includes a removable filter unit configured to receive a supply airflow generated by a blower and to filter debris from the supply airflow, a filter seat, a filter access opening, a filter access door, and a filter presence system. The filter access door is pivotable between a closed position, wherein the filter access door covers the filter access opening, and an open position, wherein the filter access door is displaced from the filter access opening to permit access to the filter seat. The filter presence system is configured to: permit the filter access door to move from the open position into the closed position when the filter unit is disposed in the filter seat; and prevent the filter access door from being moved into the closed position when the filter unit is not disposed in the filter seat. The filter presence system includes a lift arm movable between an extended position and a retracted position. When the filter access door is open, the lift arm assumes the extended position to receive the filter unit in the filter seat. Moving the filter access door from the open position into the closed position when the filter unit is disposed in the filter seat causes the lift arm to move to the retracted position.

According to some embodiments, the filter seat is a filter loading seat, and the filter presence system is configured to move the filter unit from a filter loading position to an installed filter seat when the filter access door is moved from the open position into the closed position with the filter unit disposed in the filter loading seat.

In some embodiments, when the filter unit is disposed in the filter loading seat and the filter access door is moved from the open position toward the closed position, the filter access door will contact the filter unit and push the filter unit into the installed filter seat, and when the filter unit is not disposed in the filter loading seat and the filter access door is moved from the open position toward the closed position, the filter access door will interlock with the lifting arm to prevent the filter access door from being moved into the closed position.

According to some embodiments, the mobile cleaning robot defines an internal containment chamber. The mobile cleaning robot includes an internal barrier that separates the internal containment chamber into first and second sub-chambers. The internal barrier includes an aperture providing fluid communication between the first and second sub-chambers. When positioned in the installed filter seat, the filter unit is supported by the internal barrier and over the aperture to filter airflow through the aperture.

In some embodiments, the lift arm is a first lift arm, and the mobile cleaning robot includes a second lift arm located opposite the first lift arm. The first and second lift arms define the filter loading seat therebetween.

The lift arm may be spring loaded toward the extended position.

In some embodiments, the lift arm is configured to pivot between the extended position and the retracted position about a pivot axis.

According to some embodiments, the mobile cleaning robot includes an interlock feature located on one of the filter access door and the lift arm. The interlock feature is configured to interlock with the other of the filter access door and the lift arm when the filter access door is moved toward the closed position without the filter unit disposed in the filter seat and to thereby prevent the filter access door from moving into the closed position.

In some embodiments, the interlock feature is an integral first interlock feature on the filter access door, the mobile cleaning robot includes an integral second interlock feature on the lift arm, one of the first and second interlock features is an interlock slot, and the other of the first and second interlock features is an interlock tab. The filter presence system is configured such that the interlock tab interlocks with the interlock slot when the filter access door is moved toward the closed position without the filter unit disposed in the filter seat, and the interlock between the interlock tab and the interlock slot prevents the filter access door from moving into the closed position.

The mobile cleaning robot may include a bin seating, and a debris bin removably and replaceably disposed in the bin seating. The filter seat, the filter access opening, the filter access door, and the filter presence system each form a part of the debris bin.

In some embodiments, the mobile cleaning robot includes a bin retention system to retain the debris bin in the bin seating. The bin retention system includes a latch mechanism selectively movable between a locking position, wherein the latch mechanism prevents displacement of the debris bin from the bin seating, and a releasing position, wherein the latch mechanism permits displacement of the debris bin from the bin seating.

According to embodiments, a debris bin for a mobile cleaning robot including a support structure includes a bin housing, a removable filter unit, a filter access door, and a filter presence system. The bin housing is configured to be removably and replaceably mounted in the support structure. The bin housing includes a filter seat, and a filter access opening. The removable filter unit is configured to receive a supply airflow and to filter debris from the supply airflow. The filter access door is pivotable between a closed position, wherein the filter access door covers the filter access opening, and an open position, wherein the filter access door is displaced from the filter access opening to permit access to the filter seat. The filter presence system is configured to: permit the filter access door to move from the open position into the closed position when the filter unit is disposed in the filter seat; and prevent the filter access door from being moved into the closed position when the filter unit is not disposed in the filter seat. The filter presence system includes a lift arm movable between an extended position and a retracted position. When the filter access door is open, the lift arm assumes the extended position to receive the filter unit in the filter seat. Moving the filter access door from the open position into the closed position when the filter unit is disposed in the filter seat causes the lift arm to move to the retracted position.

According to embodiments, a mobile cleaning robot includes a bin seating, a drive system, a blower, a filter unit, and a bin retention system. The drive system is operative to move the mobile cleaning robot. The blower is operative to generate a supply air flow. The debris bin is removably and replaceably disposed in the bin seating. The filter unit is disposed in the debris bin and in a path of the supply air flow. The bin retention system is configured to retain the debris bin in the bin seating. The bin retention system includes a latch mechanism selectively movable between a locking position, wherein the latch mechanism prevents displacement of the debris bin from the bin seating, and a releasing position, wherein the latch mechanism permits displacement of the debris bin from the bin seating.

In some embodiments, the debris bin includes a handle pivotable between a stored position and a raised position, and the bin retention system is transitioned from the locking position to the releasing position by pivoting the handle from the stored position to the raised position.

In some embodiments, the handle includes a handle body configured to be grasped by a user, the handle body is oriented substantially horizontal when the handle is in the stored position, and the handle body is oriented substantially vertical when the handle is in the raised position.

According to some embodiments, the mobile cleaning robot includes a support structure and the bin retention mechanism includes: a latch portion on the handle; and a latch member on the support structure, the latch member being displaceable relative to the bin seating. The latch portion engages the latch member and is movable with the handle such that: when the handle is in the stored position, the latch portion interlocks with the latch member to prevent displacement of the debris bin from the bin seating; and when the handle is transitioned from the stored position to the raised position and the debris bin is lifted from the bin seating, the latch portion displaces the latch member relative to the bin seating to permit displacement of the debris bin from the bin seating.

In some embodiments, the latch portion includes a cam feature that displaces the latch member as the handle is transitioned form the stored position to the raised position.

In some embodiments, the latch member is spring loaded.

The latch member may include a rounded engagement end that contacts the latch portion as the debris bin is inserted into the bin seating.

In some embodiments, the mobile cleaning robot includes a filter seat, a filter access opening, a filter access door, and a filter presence system. The filter access door is pivotable between a closed position, wherein the filter access door covers the filter access opening, and an open position, wherein the filter access door is displaced from the filter access opening to permit access to the filter seat. The filter presence system is configured to: permit the filter access door to move from the open position into the closed position when the filter unit is disposed in the filter seat; and prevent the filter access door from being moved into the closed position when the filter unit is not disposed in the filter seat.

Further features, advantages and details of the present invention will be appreciated by those of ordinary skill in the art from a reading of the figures and the detailed description of the embodiments that follow, such description being merely illustrative of the present invention.

DETAILED DESCRIPTION

Figure 1:
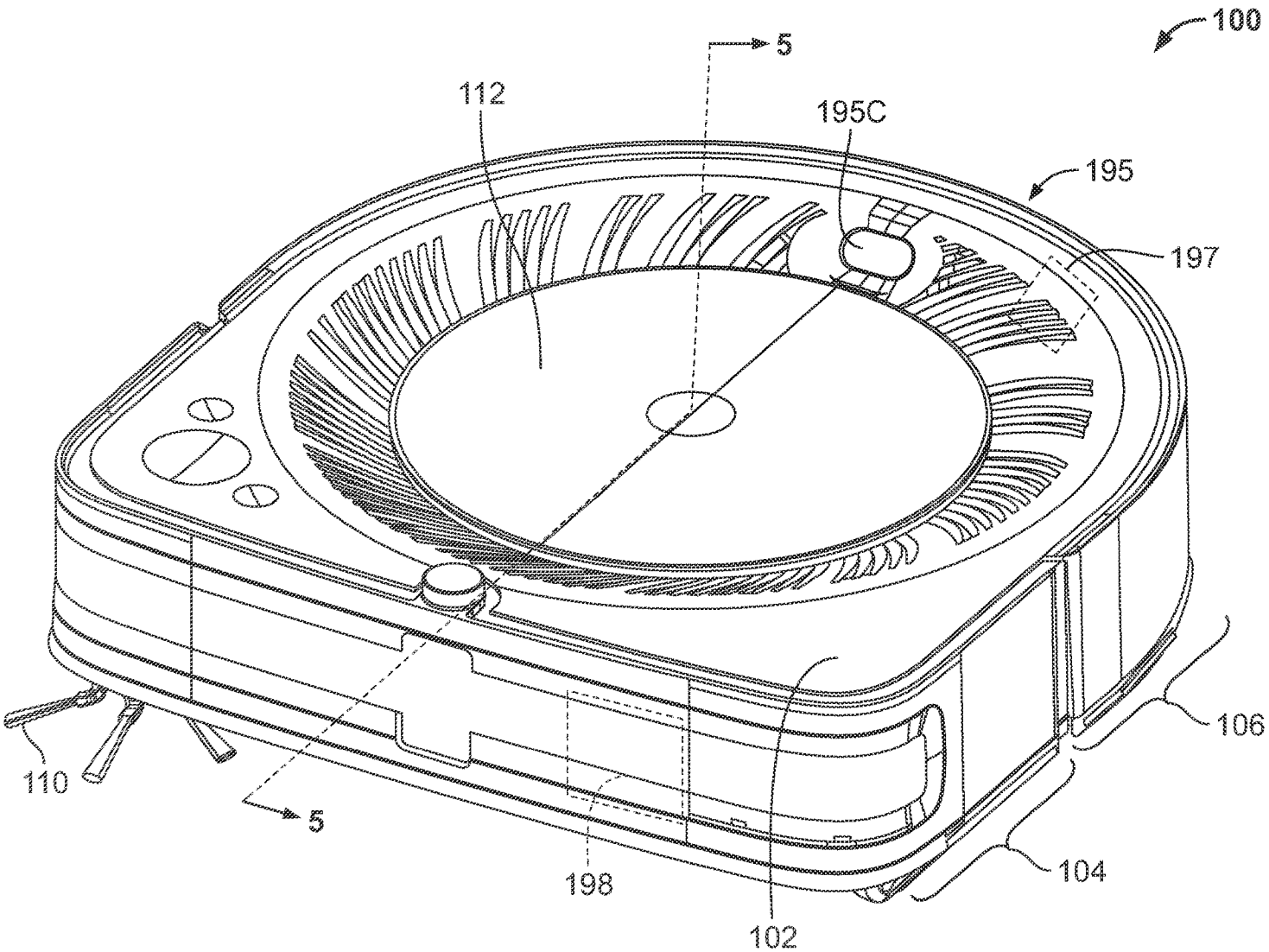
FIG. 1 is a top, front perspective view of a mobile cleaning robot according to embodiments of the invention.
Figure 2:
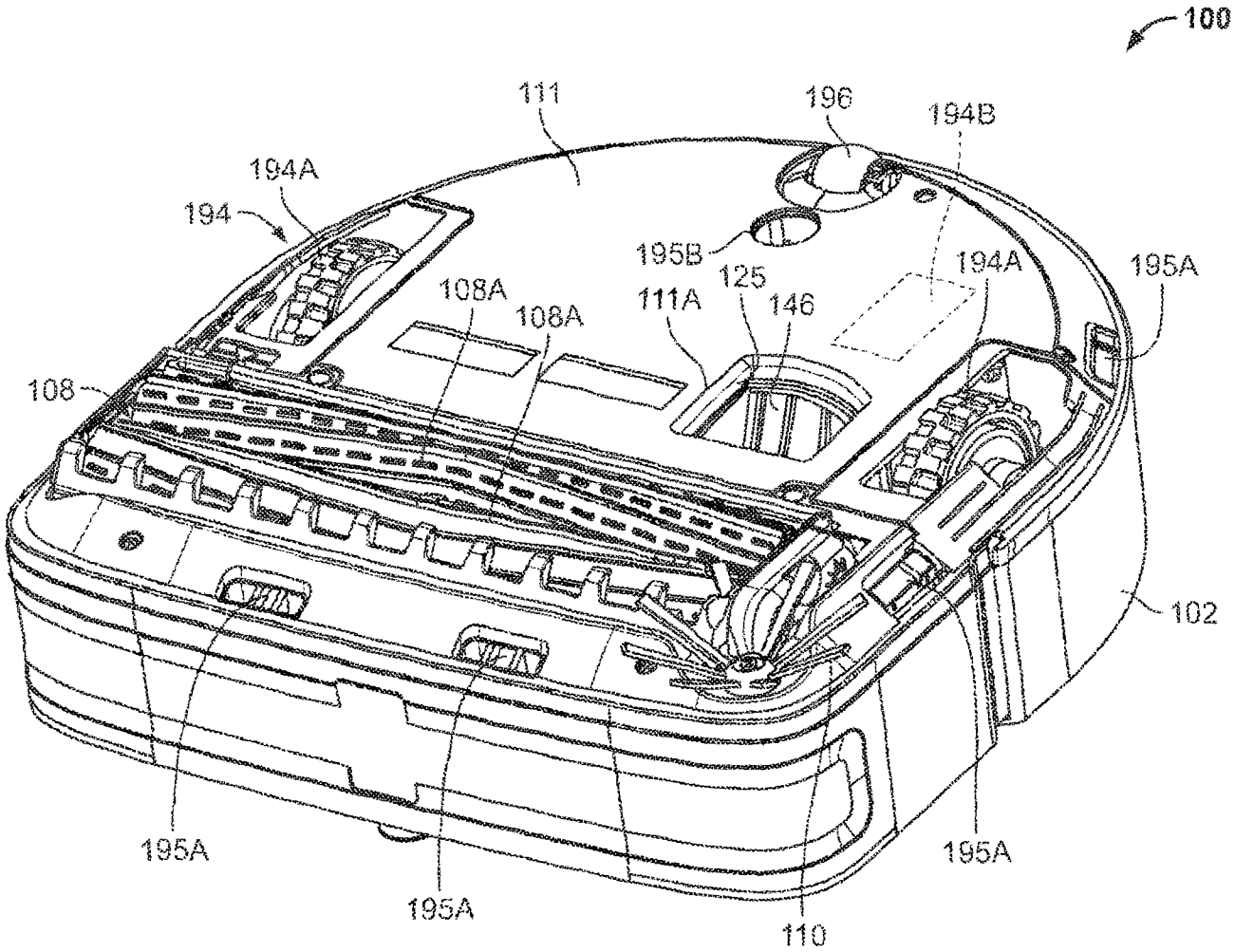
FIG. 2 is a bottom, front perspective view of the mobile cleaning robot of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The term "monolithic" means an object that is a single, unitary piece formed or composed of a material without joints or seams.

A mobile cleaning robot can navigate around a room or other locations and clean a surface over which it moves. In some implementations, the robot navigates autonomously, however user interaction may be employed in certain instances. The mobile cleaning robot collects dust and debris from the surface and stores the dust and debris in a bin (e.g., a debris bin) that can be later emptied (e.g., at a later time when the bin is at or near capacity). In some embodiments, the bin is designed for removal and emptying by a user, automatic evacuation by an evacuation device, or manual evacuation by a handheld vacuum means external to the robot. The bin rests inside the mobile cleaning robot and is positioned in an airflow path through the mobile cleaning robot for retaining debris vacuumed into the bin by the airflow. The airflow path assists in pulling debris from the surface, through the mobile cleaning robot and into the bin. The bin filters the air and a blower expels the filtered air through a vent in the mobile cleaning robot.

Figure 7:
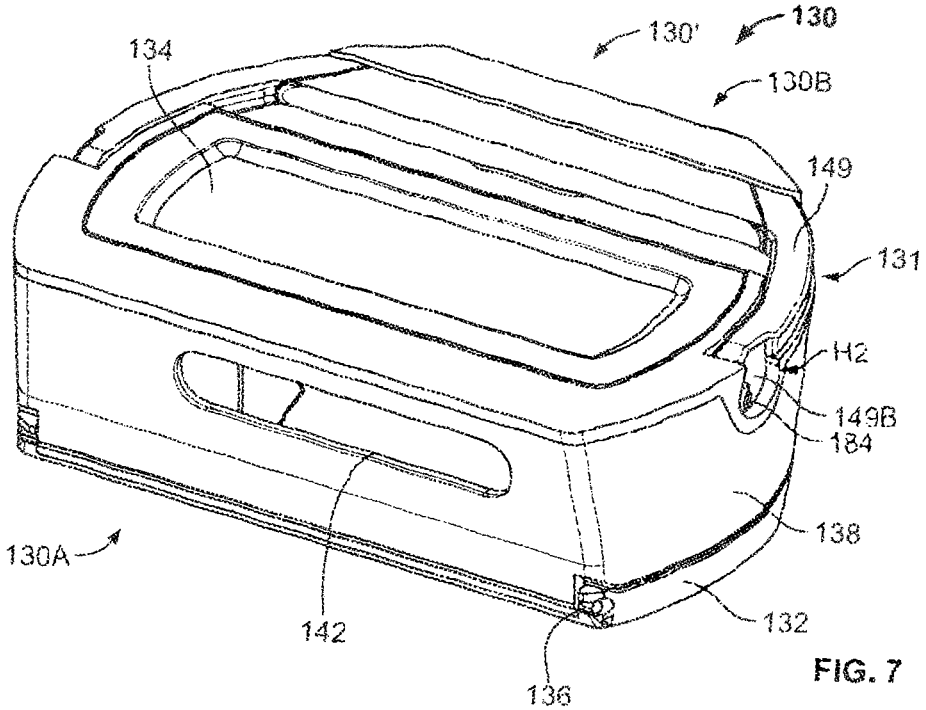
FIG. 7 is a front perspective view of the debris bin of FIG. 4, wherein a filter access door thereof is in a closed position.

FIGS. 1-23 show an exemplary mobile cleaning robot 100 that can autonomously navigate a cleaning surface and perform cleaning operations (e.g., vacuum operations) on a cleaning surface. The mobile cleaning robot 100 has a forward portion 104 and an aft portion 106. The mobile cleaning robot 100 includes a modular debris bin 130, a filter unit 150, a blower 118 (FIG. 5; e.g., a vacuum source), a cleaning head 108, a motive or drive system 194 for moving the mobile cleaning robot 100, a corner brush 110, a guidance system 195, a rear caster wheel 196, an energy storage battery 197, and an onboard controller 198. The debris bin 130 and the filter unit 150 collectively form a filtered bin assembly 130' (FIG. 7).

The robot 100 further includes a filter presence system 160 and a bin retention system 180, as described in more detail below.

In some implementations of the mobile cleaning robot 100, the forward portion 104 is square cornered with a substantially flat leading edge and the aft portion 106 is a rounded or semi-circular trailing edge, giving the mobile cleaning robot 100 a D-shaped or tombstone-shaped peripheral profile. In other implementations, the mobile robot 100 may have another peripheral profile shape such as a round profile, a triangular profile, an elliptical profile or some non-symmetrical and/or non-geometric shape or industrial design.

The drive system 194 (FIG. 2) includes left and right drive wheels 194A and one or more motors 194B operable to drive the wheels 194A. The drive wheels 194A may be independent drive wheels that mobilize the robot 100 and provide two points of contact with the floor surface. The drive wheels 194A may be spring loaded. The multi-directional caster wheel 196 provides additional support for the robot 100 as a third point of contact with the floor surface. The electric drive motor or motors 194B are disposed in the housing and operative to independently drive the wheels 194A. The motive components may include any combination of motors, wheels, drive shafts, or tracks as desired, based on cost or intended application of the robot 100.

The guidance system 195 (FIGS. 1 and 2) includes cliff detection sensors 195A, a recessed optical mouse sensor 195B aimed at the floor surface for detecting drift, and a camera 195C.

The cleaning head 108 includes cleaning elements or extractors 108A such as rotatable rollers mounted at a suction opening 108B in the underside of the robot 100. The cleaning head 108 may further include a motor operable to forcibly rotate the extractors 108A. The extractors 108A may be brush rollers and/or pliable rubber rollers, for example.

The blower 118 may be an electrical impeller fan or other vacuum source for generating airflow within the mobile cleaning robot 100.

The controller 198 (e.g., a microprocessor-based controller and associated memory) may control the drive motor 194C, the cleaning head 108, and the blower 118 using data input from the sensors 195A-C and/or other data.

The drive motor 194C, the guidance system 195 and the blower 118 may be powered by the onboard battery 197.

The mobile cleaning robot 100 includes a rigid support structure 102. The support structure 102 forms a structure that supports the blower 118, the battery 197, and the cleaning head 108. A bin emptying door or bottom cover 111 may be mounted on the bottom of the structure 102. The support structure 102 may include a unitary or non-unitary frame, chassis, body, or assembly, for example.

The support structure 102 also forms a bin receiving compartment, well or seating 120 for receiving or otherwise supporting the debris bin 130. The bin 130 can be inserted into and removed from the seating 120 selectively for servicing. When installed or received in the mobile cleaning robot 100, the debris bin 130 can collect and store debris collected from the surface being cleaned.

Figure 3:
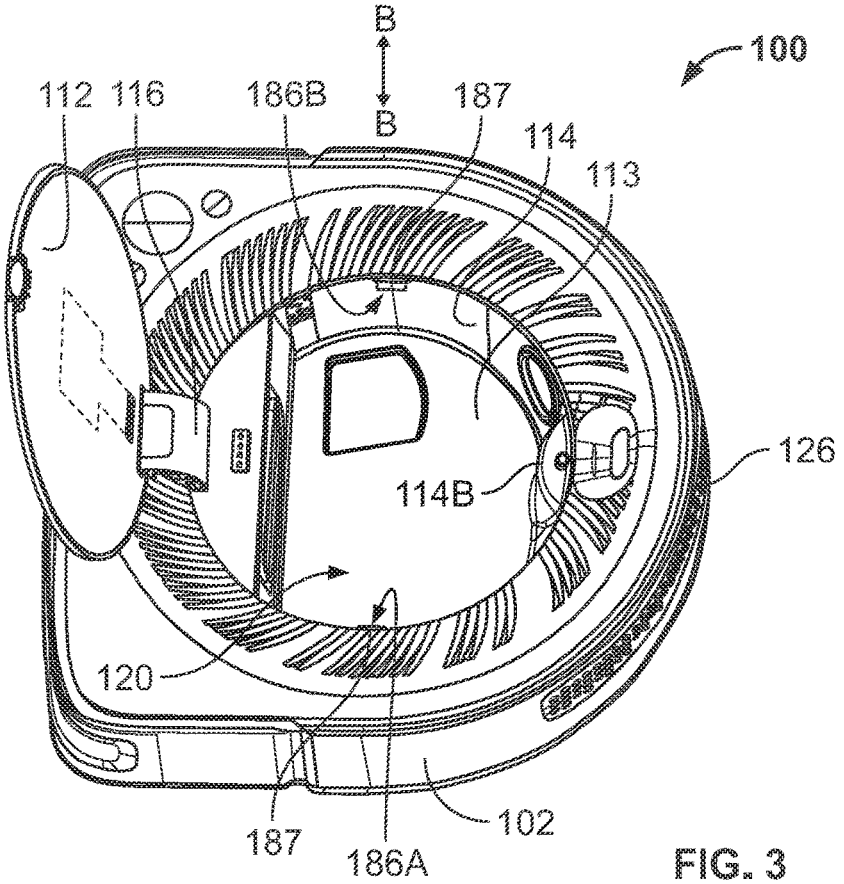
FIG. 3 is a top perspective view of the mobile cleaning robot of FIG. 1 wherein a debris bin thereof is removed.
Figure 4:
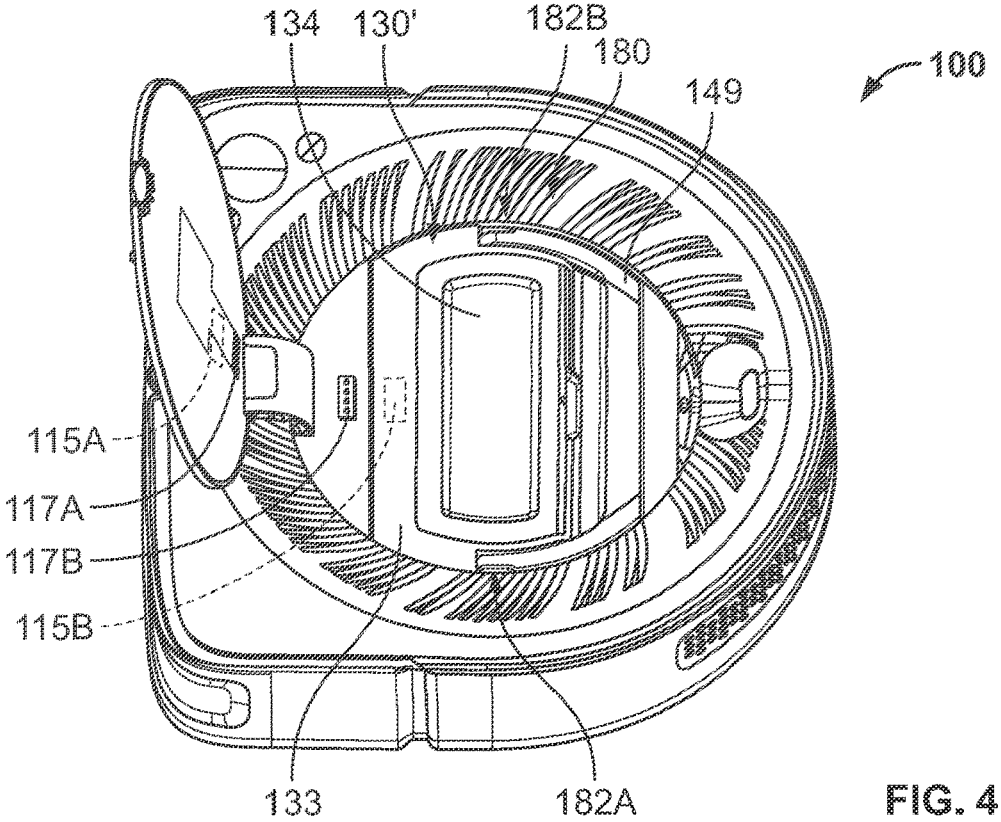
FIG. 4 is a top perspective view of the mobile cleaning robot of FIG. 1 wherein the debris bin is installed and a bin access lid of the mobile cleaning robot is in an open position.

The seating 120 has a heightwise or main axis A-A (FIG. 5) and a lateral axis B-B (FIG. 3). In some embodiments, the lateral axis B-B is substantially horizontal. In some embodiments, the lateral axis B-B is substantially perpendicular to the main axis A-A.

The seating 120 includes one or more sidewalls 114 and a floor 113 that form a cavity in the support structure 102 for receiving the debris bin 130. The lower boundary of the seating 120 is defined by the floor 113 on which the debris bin 130 rests when the bin 130 is inserted into the seating 120.

The seating 120 may have one or more peripheral profiles for receiving a matching profile of the debris bin 130 in a unique orientation that ensures complete insertion of the bin 130 and secure alignment of mating features between the debris bin 130 and the support structure 102. For example, the one or more peripheral profiles may be utilized to produce one or more keyed features 114B (e.g., a bump, indent, protrusion, etc.) so that the bin 130 is received in a particular orientation. The keyed feature 114B matches a complementary keyed feature of the bin 130. In some implementations, a portion of the sidewall 114 is tilted from vertical or the main axis A-A to form a downward and inward taper from a surface of the mobile cleaning robot 100 to the floor 113 of the seating 120. For example, all or a portion of the sidewall 114 can be sloped to form a fully or partially funneled or conical shape. A sidewall (e.g., sidewall 138) of the debris bin 130 can be shaped to match the sidewall 114 of the seating 120. For example, the seating 120 and the bin 130 may have matching non-circular shapes, such as D-shapes as shown. In some implementations, one or more portions of the sidewall 114 can be flat or approximately flat to accommodate alignment of one or more entrance and evacuation ports of the debris bin 130 with the airflow path FP of the mobile cleaning robot 100.

The shape of the seating 120 assists in properly inserting and orienting the debris bin 130 in the structure 102. During insertion, the one or more keyed features 114B can guide the bin 130 in for an appropriate positioning of the bin in the seating. A user may receive one or more types of feedback indicating a proper positioning of the debris bin 130. For example, such feedback can include audible feedback (e.g., a click, beep, or tap), tactile feedback (e.g., a physical sensation for the user such as sensing physical resistance, etc.), and/or visible feedback (e.g., a green light illuminates on a user interface of the mobile cleaning robot 100 and/or an associated application operating on a remote device communicating wirelessly with the mobile cleaning robot 100).

The mobile cleaning robot 100 includes a bin access lid or panel 112 that covers the seating 120. The bin access panel 112 encloses the debris bin 130 within the mobile cleaning robot 100 and prevents the debris bin 130 from being removed during a cleaning mission. The bin access panel 112 is affixed to the support structure 102 by a panel hinge 116 such that the bin access panel 112 can be selectively rotated open and closed over the seating 120.

In some implementations, the bin access panel 112 closes over the bin 130 only when the debris bin 130 is seated in the structure 102 with the debris bin 130 resting on the floor 113 of the seating 120 and the filter access door 134 closed. If the debris bin 130 is rotated or only partially inserted so that it is not fully inserted within the seating 120, or if a door 134 of the bin 130 is not fully closed, the bin access panel 112 will not swing closed to cover the debris bin 130. In such cases the bin access panel 112 may remain sufficiently ajar that it provides a visual indication to a user that the debris bin 130 is not properly seated or closed, thereby providing a visual prompt that corrective action is needed. In some implementations, the mobile cleaning robot 100 includes one or more mechanisms to prevent the mobile cleaning robot 100 from operating when the bin access panel 112 is ajar. In some implementations, the mobile cleaning robot 100 includes one or more mechanisms to prevent the mobile cleaning robot 100 from operating if the bin access panel 112 is forced closed despite the debris bin 130 not being seated against the floor 113 of the seating 120 or closed.

The bin 130 includes a housing 131, a filter access lid or door 134, an interior barrier 137, a door latch mechanism 148, a handle 149, and the filter presence system 160.

The bin housing 131 has a forward end 130A and an aft end 130B. The housing 131 includes a top wall 133, an emptying door or bottom wall 132, a sidewall 138, and an internal barrier 137. The top wall 133 defines a filter access opening 140A. The top wall 133, the bottom wall 132, and the sidewall 138 collectively define an internal containment volume or chamber 140 in fluid communication with the opening 140A. The internal barrier 137 is disposed in the chamber 140.

The sidewall 138 wraps around the sides of the bin 130 in a shape that is complementary to the seating 120. The sidewall 138 includes an exhaust port 144 and an intake port 142. In some implementations, the sidewall 138 includes one or more keyed features, such as an indent, that assists a user in grasping the bin 130 and that ensures properly orienting the bin 130 in the seating 120. The one or more keyed features include any number of asymmetrical features of the sidewall 138 that assist the user for orienting the bin 130 when placing the bin in the seating 120. The asymmetry of the keyed features prevents the bin 130 from rotating or shifting inside the seating 120, such as during operation of the mobile cleaning robot 100.

In some implementations, the intake port 142 includes an elongated, pseudo-elliptical aperture that matches an abutting aperture of a debris intake duct 122 (FIG. 5) of the cleaning head 108. In some implementations, the edge of the intake port 142 includes a pliable lip that forms an intake port seal for sealing the intake port with the duct 122 when the bin 130 is fully installed in the seating 120.

When the bin 130 is seated in the seating 120, the exhaust port 144 aligns with an intake duct 118A (FIG. 5) of the blower 118. In some implementations, an exhaust port seal (e.g., a pliable lip) is provided around the exhaust port 144 and forms a seal with the surface about the blower intake duct 118A.

Figure 9:
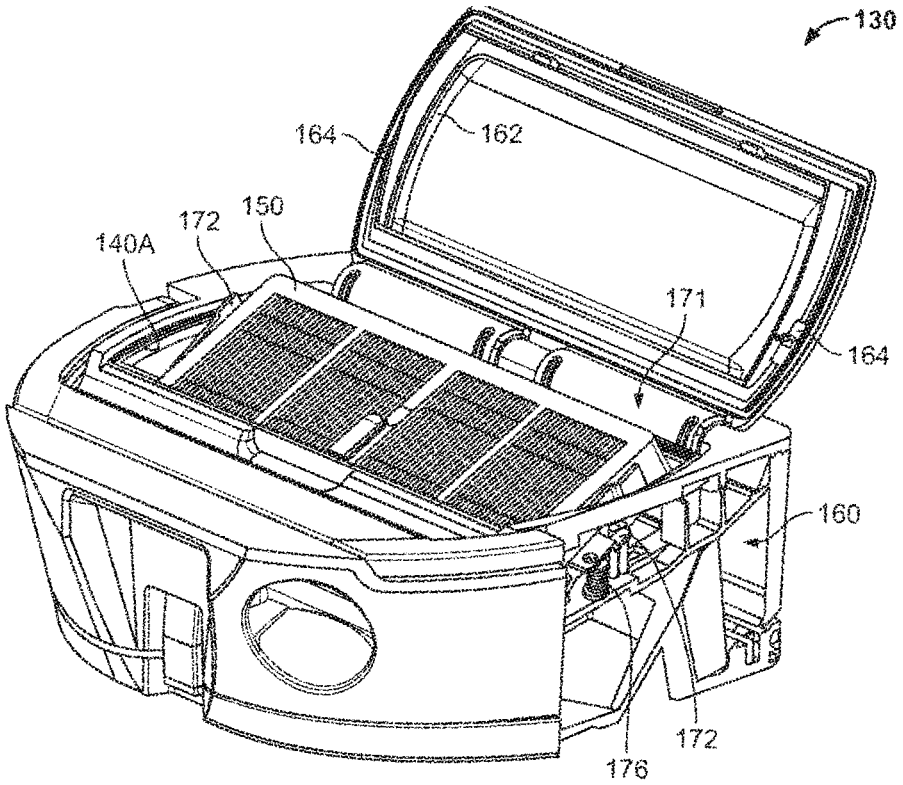
FIG. 9 is a fragmentary, rear perspective view of the debris bin of FIG. 4, wherein the filter access door is in the open position, lift arms of the debris bin are in an extended position, and the filter unit is positioned in a filter loading seat of the debris bin.
Figure 11:
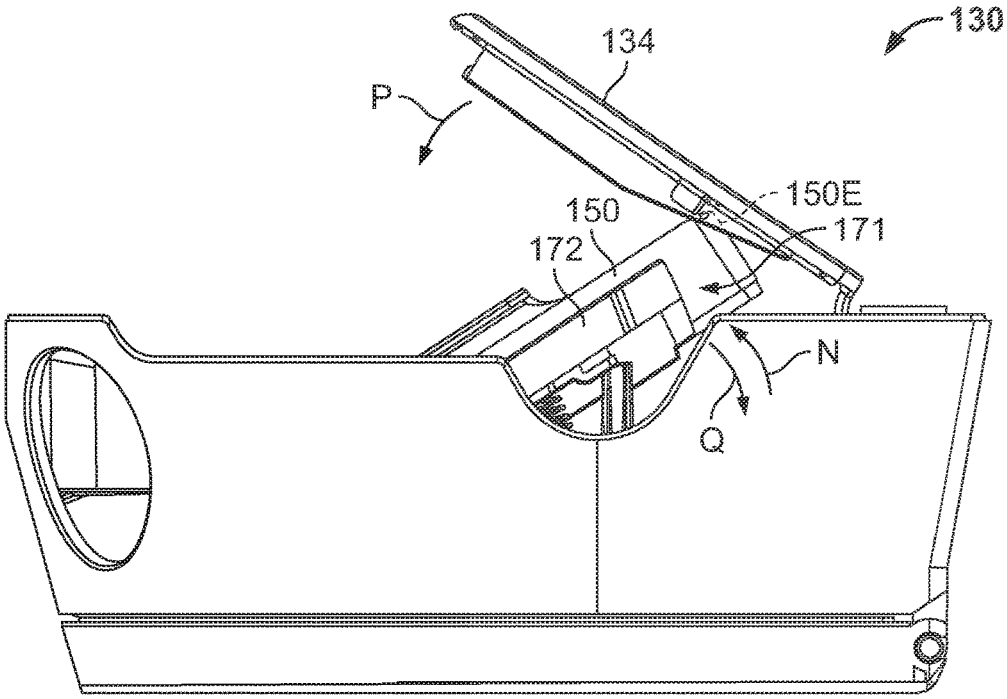
FIG. 11 is a side view of the debris bin of FIG. 4, wherein the filter unit is positioned in the filter loading seat and the filter access door is partially closed to a point of contact with the filter unit.
Figure 12:
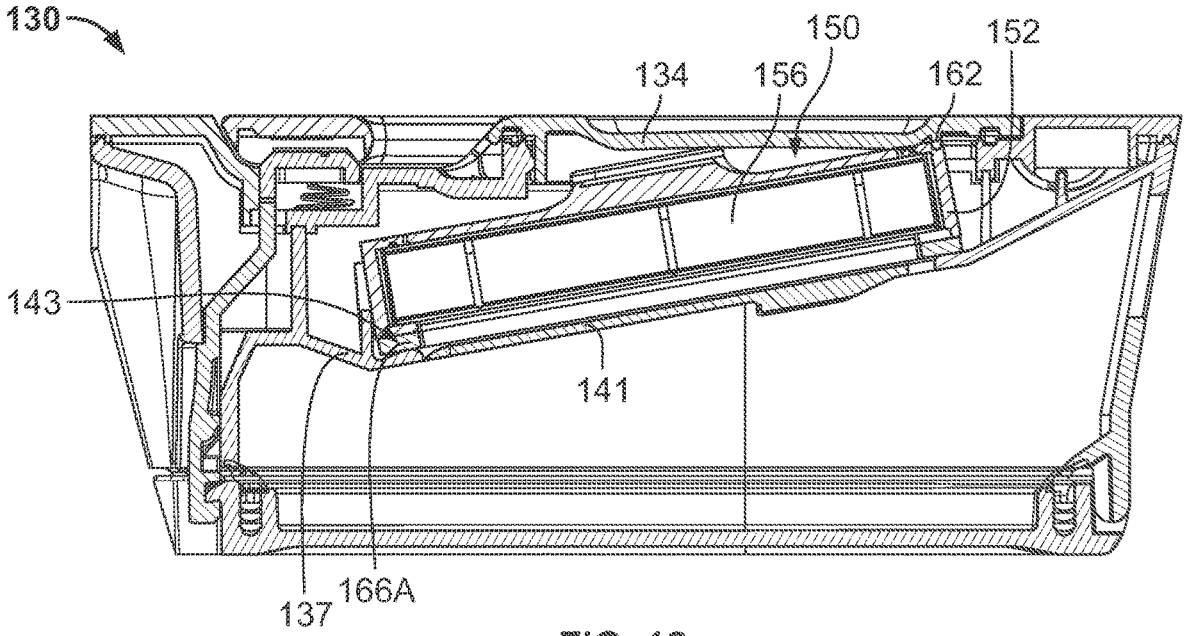
FIG. 12 is a cross-sectional view of the debris bin of FIG. 4 taken along the line 5-5 of FIG. 1.

The filter access door 134 is pivotably coupled to the top wall 133 by a hinge 135. The filter access door 134 includes a door body or panel 134B and integral latch features 134C. The door 134 can be rotated about a pivot axis C-C (FIG. 8) of the hinge 135 between a closed position (FIGS. 7 and 12)

and an open position (FIGS. 9 and 11). In its closed position, the door 134 fully covers and closes the opening 140A, and thereby forms a further wall defining the chamber 140. In its open position, the door 134 is displaced from and does not cover the opening 140A, thereby opening the chamber 140 to access by a user.

The latch features 134C are positioned and configured to releasably engage a cooperating latch feature (e.g., slots or a ledge) on the housing 131 to releasably secure the door 134 in the closed position. The door 134 may include a seal 134A (e.g., a pliable rubber strip) to form a fluid tight seal between the door 134 and the housing 131 when the door 134 is closed and latched. The seal 134A prevents air from passing through the opening 140A when the filter door 134 is closed.

The filter door body 134B may be formed of a transparent material such that the filter unit 150 is visible in the bin 130 when the filter door 134 is closed. The filter door 134 is positioned to allow access to the filter unit 150 so that the user can replace or remove the filter unit 150 from the bin 130 without removing the top wall 133 of the bin.

The filter door 134 further includes an integral door flange 162 and integral interlock features 164, as discussed in more detail below with regard to the filter presence system 160.

Figure 5:
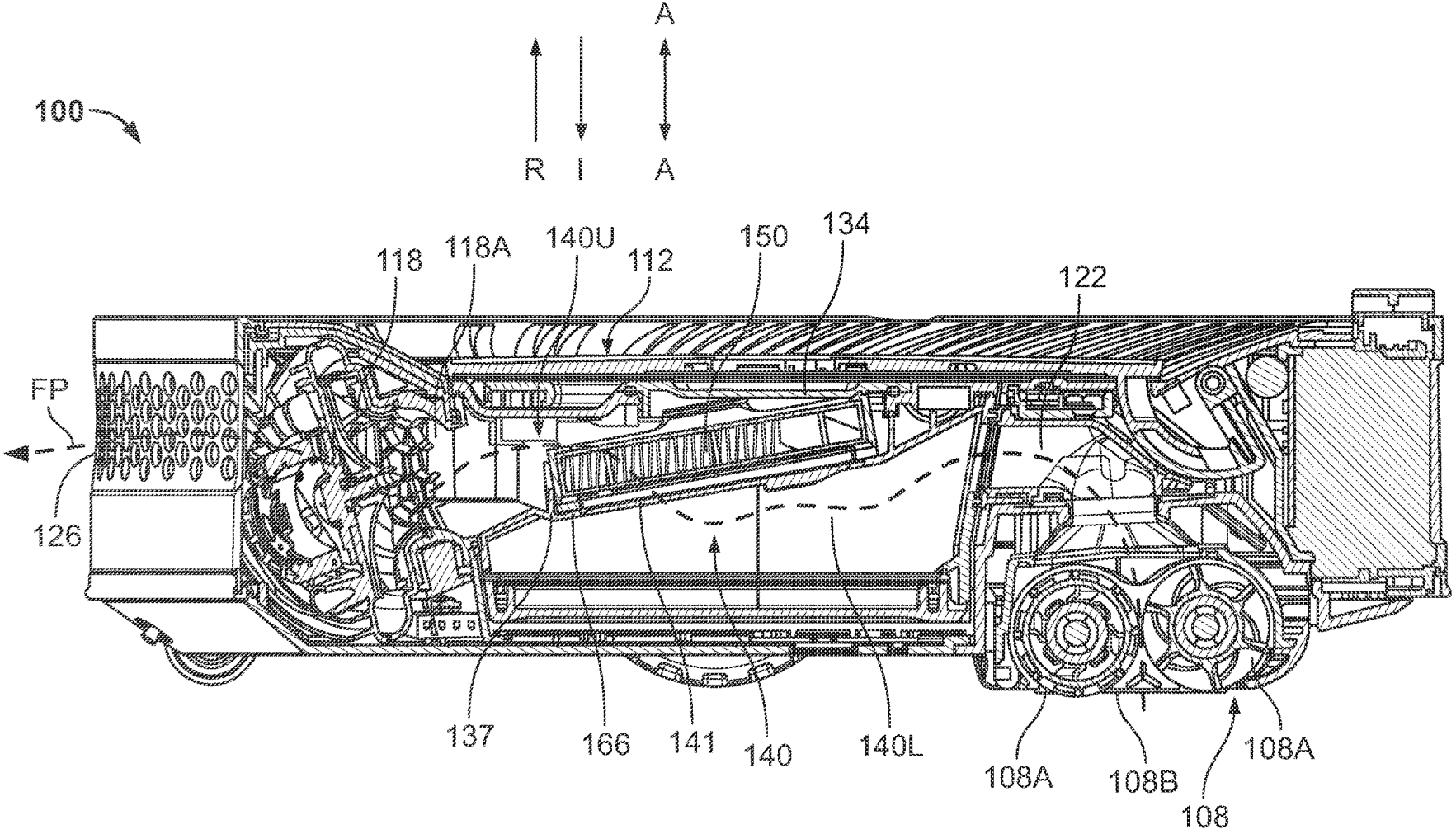
FIG. 5 is a cross-sectional view of the mobile cleaning robot of FIG. 1 taken along the line 5-5 of FIG. 1.
Figure 6:
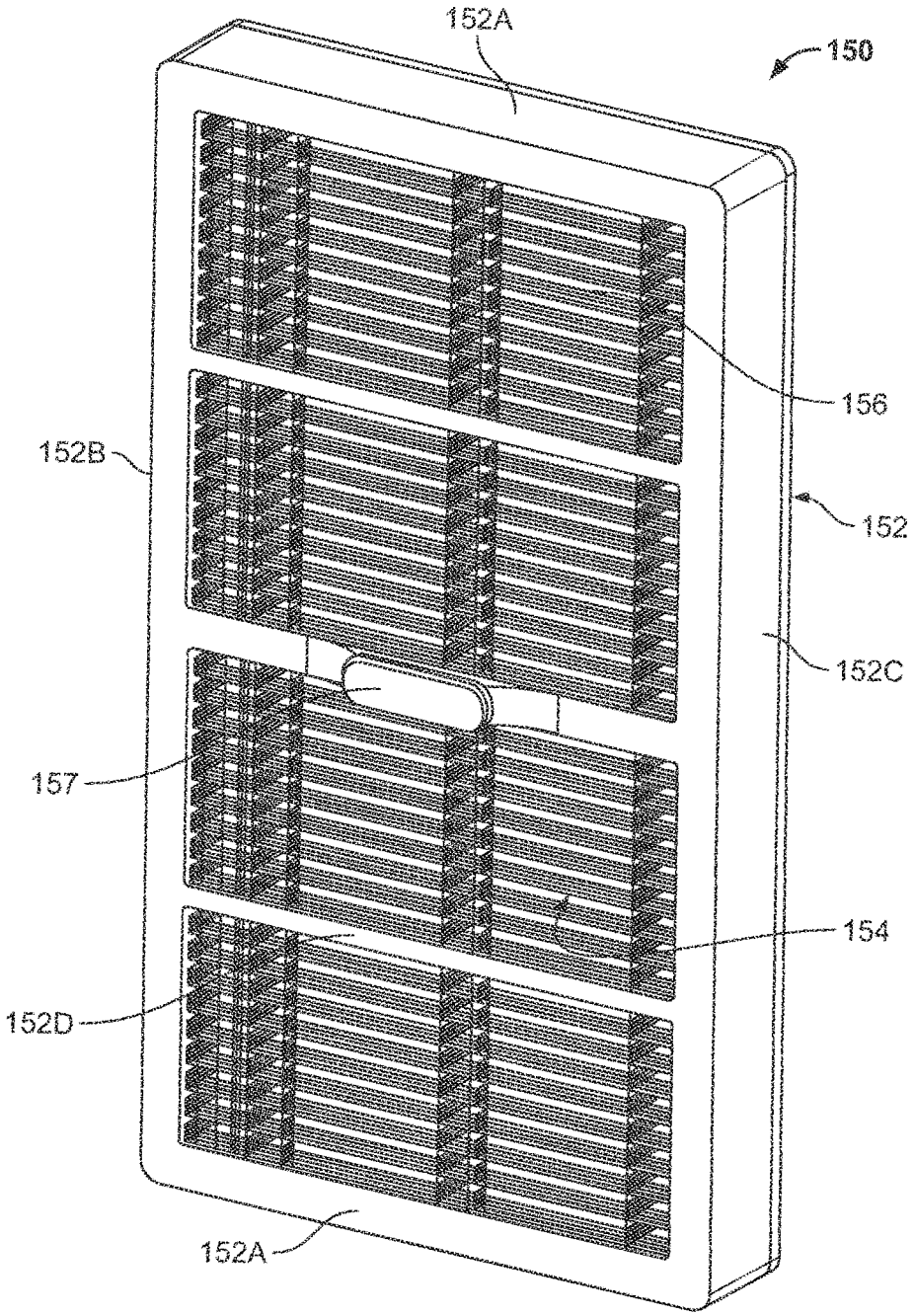
FIG. 6 is a top perspective view of a filter unit forming a part of the mobile cleaning robot of FIG. 1.

The internal barrier 137 includes a lip or ledge 166 and defines a filter flow through aperture 141 (FIG. 5). The interior barrier 137 separates or partitions the chamber 140 into a lower or first internal containment subchamber or volume 140L and an upper or second internal containment subchamber or volume 1401 on either side of the internal barrier 137. The first volume 140L is fluidly connected to the second volume 140U by the filter flow through aperture 141.

A seal 166A (FIG. 12) can be mounted on the ledge 166. The seal 166A may be a rubber strip or other sealing material. The seal 166A may extend fully about the perimeter of the aperture 141.

In use, the filter unit 150 is installed over the aperture 141. The filter unit 150 is supported inside the containment volume 140 by the internal barrier 137 and rests on the ledge 166 surrounding the aperture 141. The ledge 166 defines an installed filter seat 143 to receive and hold the filter unit 150 during cleaning operations.

During cleaning operations, the first volume 140L receives dust-laden air and debris from the cleaning head 108 though the intake port 142 and expels air through the filter unit 150. During operation, the second volume 140U receives filtered air from the first volume 140L through the filter unit 150 and expels air through the exhaust port 144. The blower 118 sucks in cleaned air through the exhaust port 144 and expels the air from the mobile cleaning robot 100, through a vent 126 in the aft portion 106.

The first volume 140L stores the debris collected by the cleaning head 108, such as dust or debris lifted from a cleaning surface on which the mobile cleaning robot 100 travels.

The internal barrier 137 prevents airflow FP from entering the second volume 140U of the bin 130 from the first volume 140L, and thereby prevents entry of debris from the first volume 140L to the second volume 140U except through the aperture 141.

In some implementations, the exhaust port 144 is located nearer the top wall 133 than the bottom wall 132 to allow the first volume 140L to be relatively larger in size.

In some embodiments, a bottom door opening 140B is defined in the bottom of the bin 130 and the bottom wall 132 is a door that is pivotably coupled to the sidewall 138 by a hinge 136. The bottom door 132 can be selectively pivoted about the hinge 136 between a closed position and an open position. In its closed position, the door 132 fully covers and closes the opening 140B. In its open position, the door 132 is displaced from and does not cover the opening 140B, thereby opening the chamber 140 to empty the bin 130.

The bin 130 further includes a latch mechanism including a door latch 148B and an actuator button 148A. The latch 148B extends from an edge of the bottom wall 132. The latch 148B extends from the edge of the bottom wall 132 and releasably secures the edge to the sidewall 138. The button 148A can be depressed to open the latch 148B to release the bottom wall 132 for emptying the bin 130.

In some implementations, a seal extends around the edge of an interior surface of the bottom wall 132. The seal prevents air from entering and debris from exiting the bin 130 through the bottom of the bin 130 when closed with the latch 148B.

In some implementations, the bin 130 includes an evacuation port 146. The evacuation port 146 is an additional port in the bottom wall 132 that remains closed during some operations, such as cleaning operations, but can open for other operations, such as bin 130 evacuation operations. The seating 120 includes a seating aperture 125 in the floor 113. When the bin 130 is properly seated in the structure 102, the evacuation port 146 of the bin 130 aligns with the seating aperture 125.

The bottom cover 111 has a bottom surface including a bottom surface aperture 111A. The bottom surface aperture 111A aligns with the seating aperture 125 to form an open passage from the bin 130 inside the mobile cleaning robot 100 to the exterior of the mobile cleaning robot 100. The open passage enables evacuation of the bin 130 while the bin is seated inside the mobile cleaning robot 100, such as by an external evacuation mechanism.

Evacuation can occur autonomously from an external evacuation station. When the mobile cleaning robot 100 determines that evacuation of the debris bin 130 is needed (e.g., the bin 130 is full or at the request of a remote application such as a mobile device application), the mobile cleaning robot 100 navigates to the evacuation station. The evacuation station can be integrated with a docking station (e.g., a charging dock). For example, evacuation can occur during a recharge of a power system of mobile cleaning robot 100. When the mobile cleaning robot 100 navigates to the external evacuation station, the evacuation port 146 aligns with a suction mechanism of the external evacuation station, and the debris inside the bin 130 is sucked from the bin 130 through the evacuation port 146. In some embodiments, a user possesses a remote computing device (e.g., a mobile phone or other mobile device) that includes a robot control application and is networked to the robot 100. The robot control application enables the user to monitor the fullness state of the debris bin 130 via the mobile device (e.g., by sending a request to and/or receiving an unsolicited notification from the robot 100). The user can then use the robot control application to send the robot 100 a command to empty the bin 130, responsive to which the mobile cleaning robot 100 will navigate to the evacuation station.

The evacuation port 146 may include a valve or movable flap or barrier that moves between an open position and a closed position. The movable barrier selectively seals and opens enabling evacuation of the contents of the bin 130. In the closed position, the flap blocks air flow between the debris bin and the environment. In the open position, a path is formed in the open passage through the flap between the debris bin 130 and the evacuation port 146. The movable barrier may open in response to a difference in air pressure at the evacuation port 146 and within the debris bin 130. The evacuation station can generate a negative air pressure (e.g., a suction force) that causes the flap to open and sucks the debris out of the bin 130 and to the evacuation station. The evacuation of the bin 130 by the evacuation station can occur autonomously without the bin 130 being removed from the mobile cleaning robot 100. The bin 130 may include a biasing mechanism (e.g., a torsion spring) that biases the movable barrier into the closed position.

The handle 149 includes a handle body 149A, opposed integral hinge portions 149B, and opposed integral handle latch portions 184. In some embodiments and as shown, the handle latch portions 184 are located on the hinge portions 149B.

Figure 21:
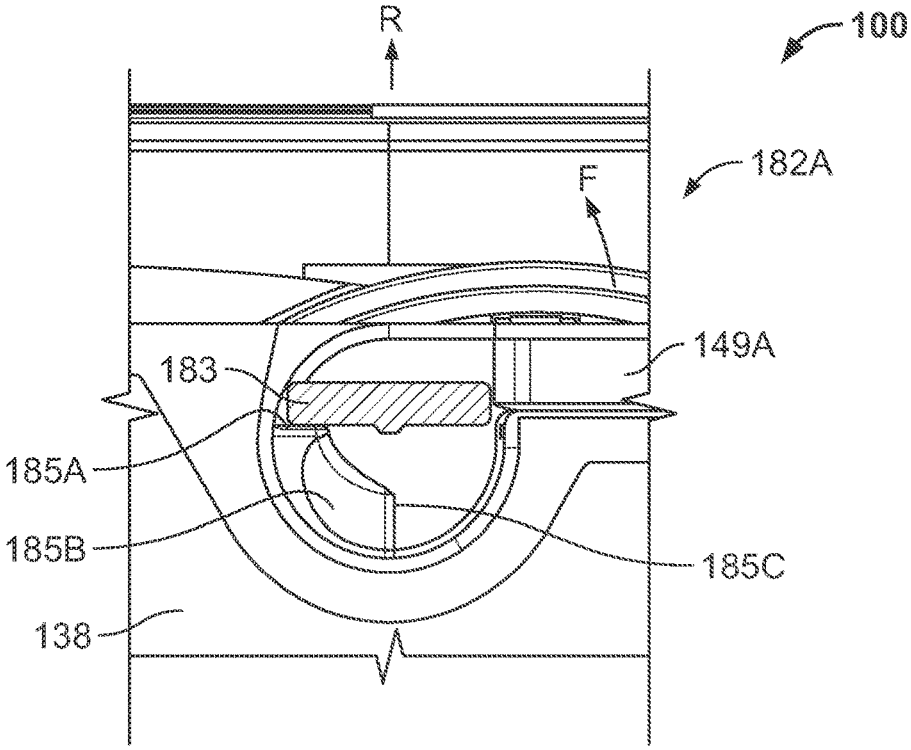
FIG. 21 is a cross-sectional view of the latch mechanism taken along the line 21-21 of FIG. 20.
Figure 22:
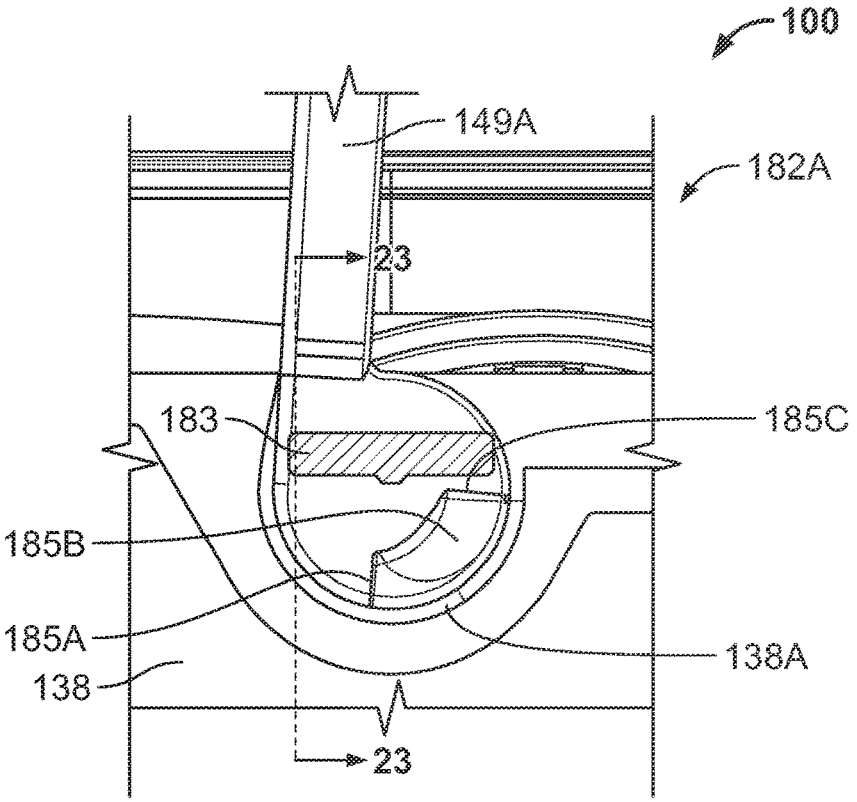
FIG. 22 is a cross-sectional view of the latch mechanism taken along the line 21-21 of FIG. 20, wherein the latch mechanism is in a releasing position.

The handle 149 is pivotably coupled by the hinge portions 149B to the top wall 133 by opposed hinges H2. The hinges H2 enable the handle 149 to pivot about a pivot axis E-E (FIG. 8) in a direction F (FIG. 21) between a stored or retracted position (FIGS. 7 and 21) and a raised or extended position (FIG. 22).

In some embodiments, the handle 149 is substantially orthogonal with the top wall 133 in the extended position. In some implementations, the handle 149 lies on or closely adjacent the top wall 133 when in the stored state. In some implementations, the handle 149 is disposed in a recess of the top wall 133 of the bin 130 during the stored state such that the handle 149 and the top wall 133 of the bin 130 form an approximately flush surface. Such a configuration can reduce the overall volume envelope of the bin 130. The bin access panel 112 can close over the bin 130 and the handle 149 without the handle 149 protruding from the mobile cleaning robot 100.

In some implementations, the locations of the handle hinges H2 and the pivot axis E-E are chosen to be along or near an approximate center of mass of the bin 130 such that the bin, when hanging from the hinged handle 149, is nearly or approximately balanced and level but the bin inlet 142 tipped upward. For example, the user can grasp the handle 149 and lift the bin 130 with a single hand without needing to balance or steady the bin with a second hand.

Figure 18:
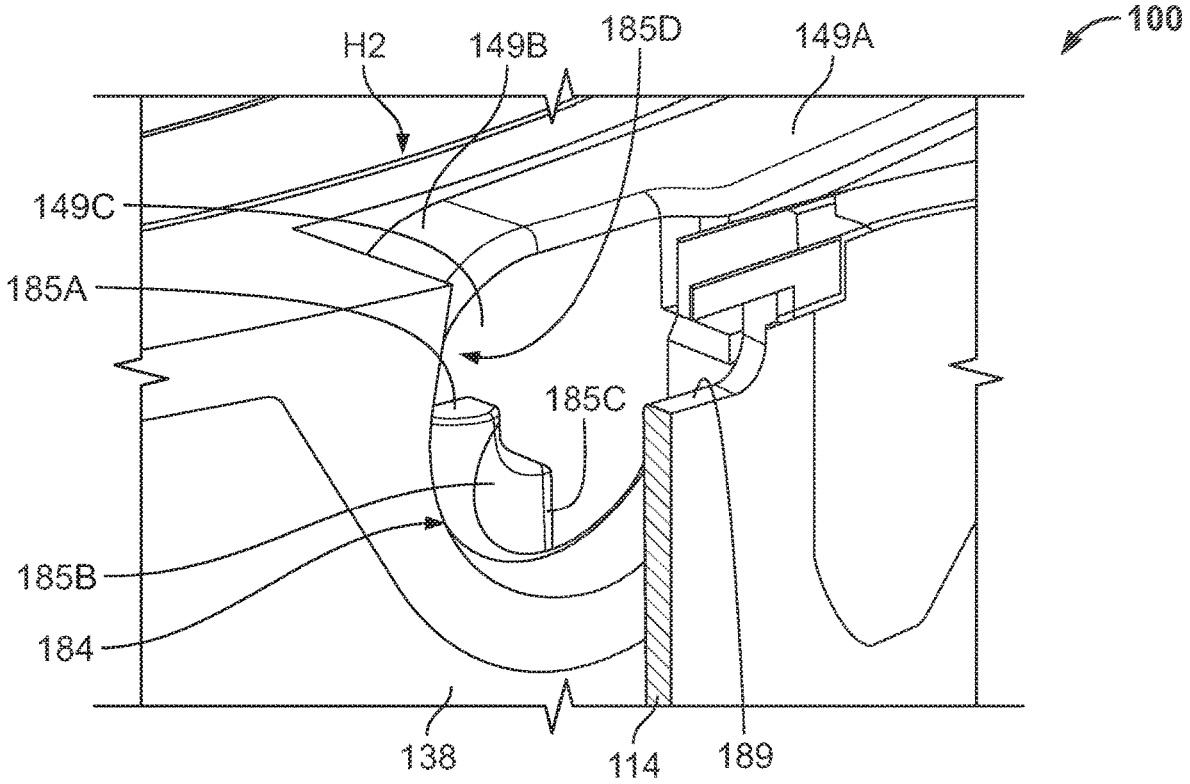
FIG. 18 is a fragmentary, perspective view of the mobile cleaning robot of FIG. 1 showing a latch mechanism thereof.
Figure 19:
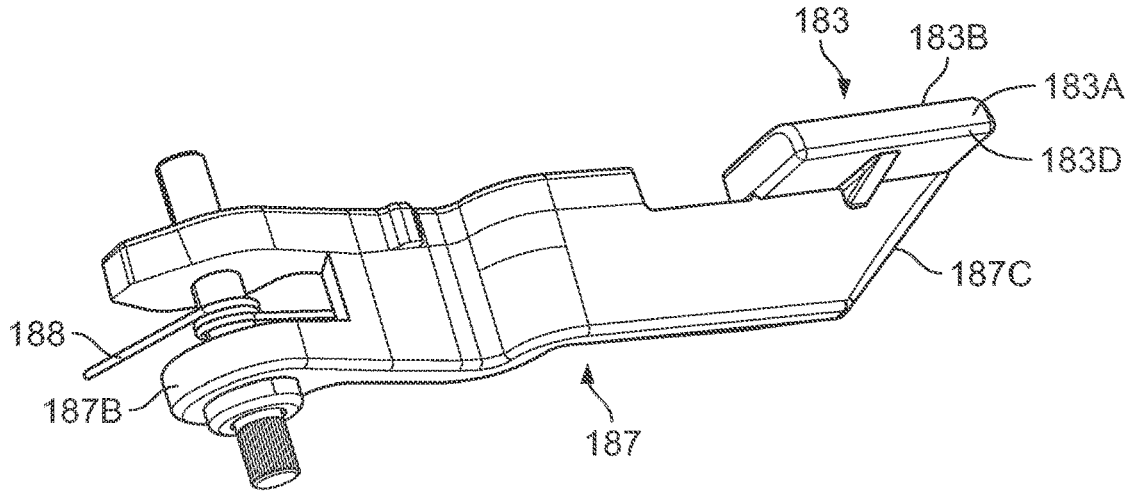
FIG. 19 is a perspective view of a latch member forming a part of the latch mechanism of FIG. 18.
Figure 23:
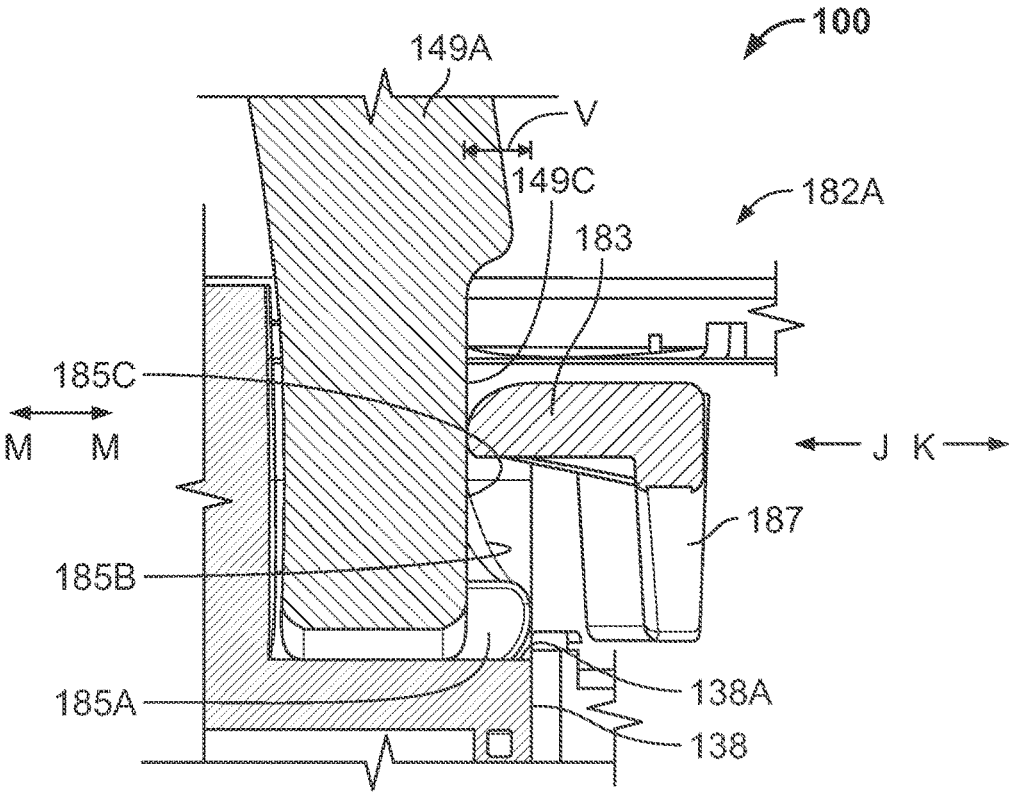
FIG. 23 is a cross-sectional view of the latch mechanism taken along the line 23-23 of FIG. 22, wherein the latch mechanism is in the releasing position.

Each handle latch portion 184 includes integral, geometric latch features 185A, 185B (FIG. 18). The latch feature 185A is a substantially flat or planar land. The land 185A may define a substantially horizontal plane. The plane of the land 185A may be non-intersecting with the handle hinge axis E-E. The latch feature 185B is an angled surface that is angled obliquely with respect to the axis M-M (FIG. 23). In some embodiments and as shown, the latch feature 185B is a generally truncated circular ramp. The ramp 185B extends from a lead end 185C to the land 185A. The ramp 185B tapers in a direction from the land 185B to the lead end 185C. The lead end 185C may terminate in the plane of the outer face 149C of the handle hinge portion 149B so that the transition from the outer face 149C to the ramp 185B is smooth and stepless. The ramp 185B may have a smooth profile that follows a uniform or nonuniform curve. A socket 185D is defined by the land 185A and the outer face 149C above the land 185A. In some embodiments, the latch feature 185B serves as a displacement guide ramp. In some embodiments, the latch feature 185B operates as a cam.

The latch features 185A, 185B may be molded, machined or otherwise formed in the ends of the handle 149. In some embodiments, the latch portions 184 are monolithic with the remainder of the handle 149.

The filter unit 150 includes a frame 152 and filter media 156. The frame 152 includes opposed side walls 152A and opposed end walls 152B, 152C. The walls 152A, 152B may be integrated to form an endless closed wall or casing, as shown. The walls 152A, 152B define a through passage 154. The filter media 156 is contained in and spans the through passage 154. In some embodiments, the walls 152A, 152B are U-shaped (in cross-section) rails that receive the edges of the filter media 156. The frame 152 may include crossbeams 152D extending between the end walls 152B, 152C and across the through passage 154 to support the filter media 156. A pull-tab 157 protrudes from the frame 152. The pull-tab 157 is sized to be grasped by a user for removal of the filter unit 150 from the bin 130.

The filter media 156 may be formed of any suitable material. In some implementations, the filter material 156 includes a fibrous material that allows air to pass through the material but traps dust, debris, etc. The filter material 156 may include folds that increase the surface area of the filter material exposed to the airflow path. In some embodiments, the filter material 156 covers the entire airflow path through the filter unit 150.

The filter frame 152 may be formed of any suitable material. In some implementations, the frame 152 is formed of a rigid polymeric material.

The filter presence system 160 includes the ledge 166 of the internal barrier 137, the interlock features 164 of the filter door 134, and a lifting mechanism 170. The components of the system 160 cooperate to position the filter unit 150 for use and removal, and to prevent closure of the filter door 134 when a filter unit 150 is not in place.

Figure 10:
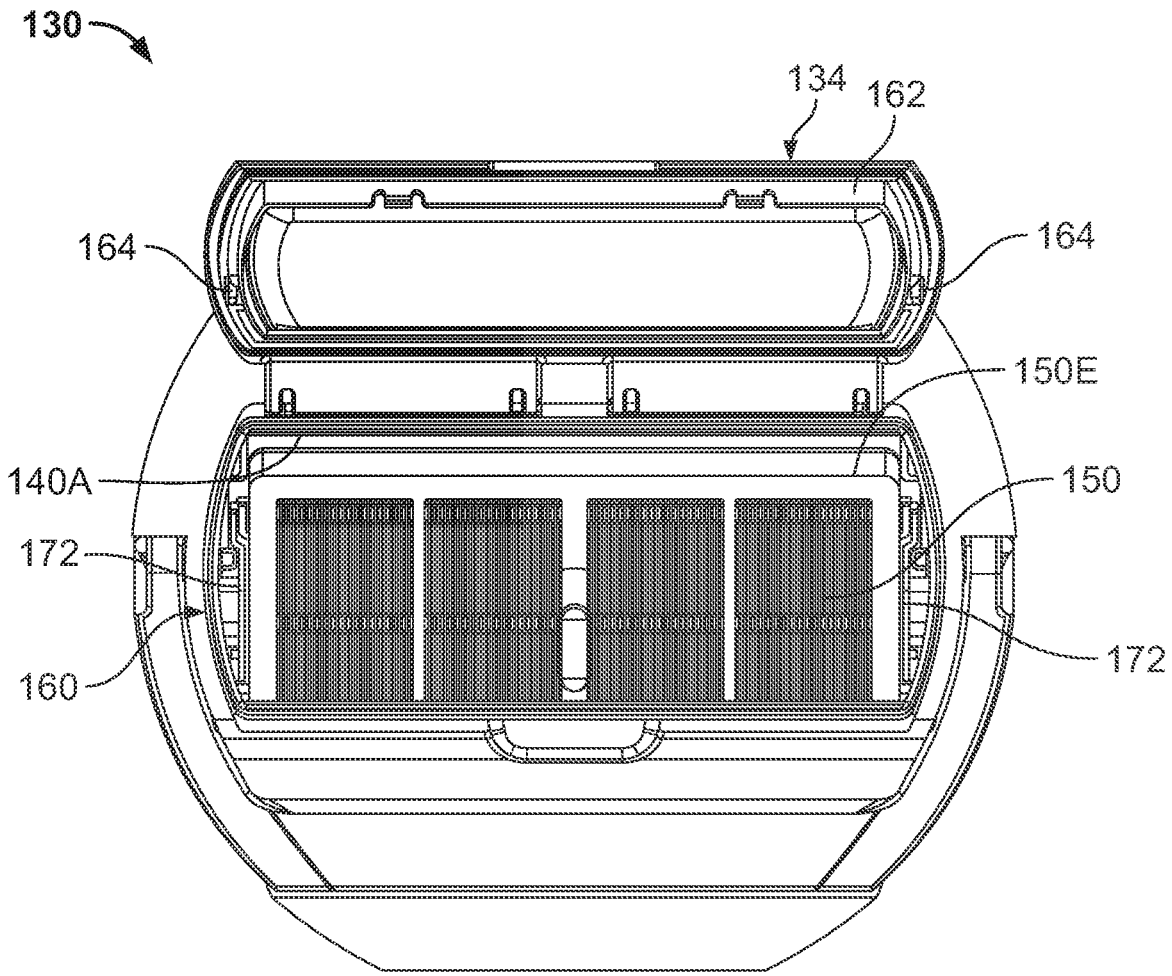
FIG. 10 is a top view of the debris bin of FIG. 4 in the configuration of FIG. 9.
Figure 13:
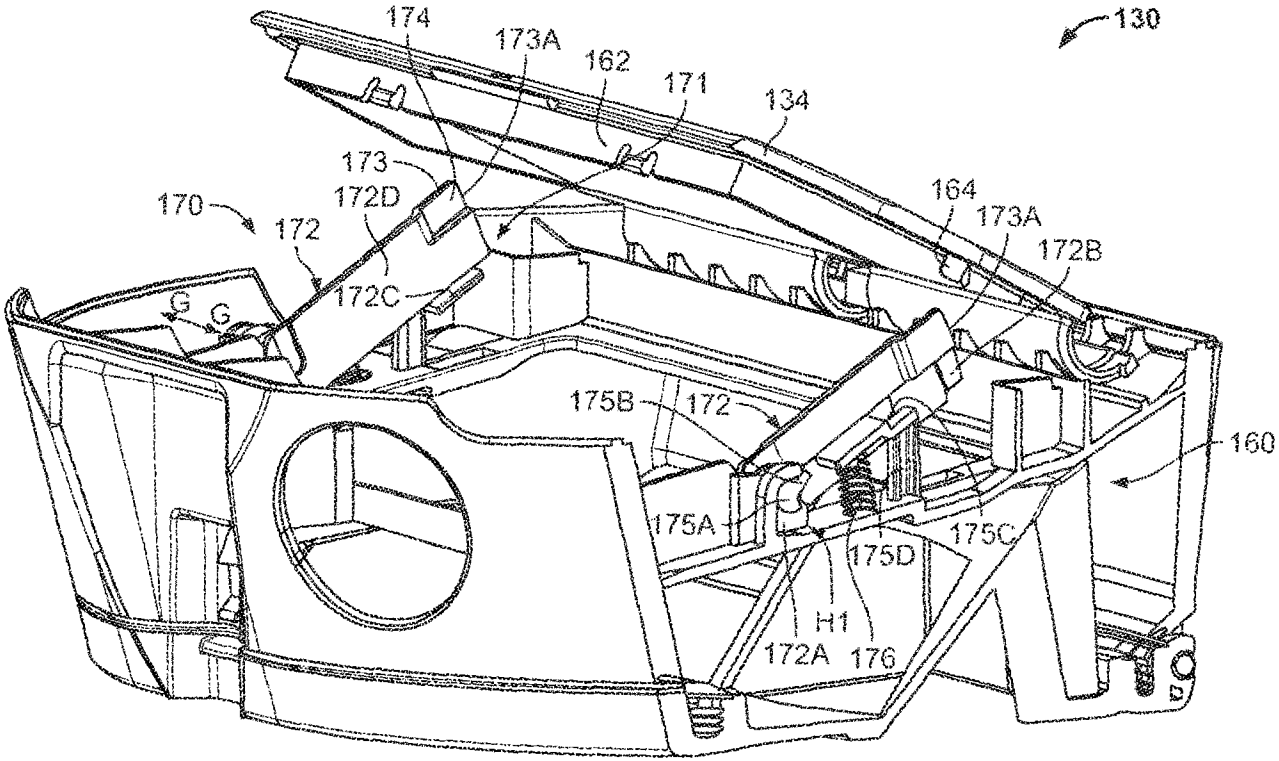
FIG. 13 is a fragmentary, rear perspective view of the debris bin of FIG. 4, wherein the filter unit is not in the debris bin and the filter access door is open.

With reference to FIGS. 9, 10 and 13, the lifting mechanism 170 includes a pair of laterally opposed lift arms 172. Each arm 172 has a proximal or pivot end 172A and a distal or free end 172B. Each arm 172 is pivotally coupled to the bin housing 131 by an integral hinge post 175A at a hinge H1. The hinges H1 enable the arms 172 to pivot about a hinge pivot axis G-G (FIG. 13) between a prescribed retracted position (FIGS. 5, 7, 8 and 12; which may also be referred to as a seated position) and a prescribed extended position (FIGS. 9-11, 13 and 15; which may also be referred to as a deployed or receiving position). In the retracted position, the arms 172 are positioned adjacent or in contact with the ledge 166. In the extended position, the arms 172 are raised above the ledge 166. The hinge post 175A has a limiter stop tab 175B to limit upward pivot of the arm 172 to the prescribed raised position. The arm 172 may further include an integral guide slot 175C that slidably receives a fixed guide post 175D to stabilize the arm throughout its motion.

Each arm 172 includes a longitudinally and vertically extending main or side wall 172D. Each arm 172 also includes a filter support tab 172C projecting laterally inwardly from the lower edge of the side wall 172D proximate the free end 172B. The side walls 172D and the support tabs 172C collectively form a filter loading seat 171 to receive and support the filter unit 150.

Each arm 172 includes an interlock feature in the form of a stop tab or wall 173. Each arm 172 further includes recess 174 laterally adjacent and defined by the stop wall 173. Each stop wall 173 and recess 174 is located at the free end 172B of the associated arm 172. The stop wall 173 has an end edge 173A.

Each arm 172 is biased or loaded from the retracted position to the extended position by a biasing mechanism. In some embodiments and as shown, each biasing mechanism is a spring 176 and each arm 172 is spring loaded. The springs 176 may be coil springs, for example. However, other types of biasing mechanisms or springs may be used. A single biasing mechanism (e.g., spring) may be used to bias both arms 172, or one or both of the arms 172 may be biased by more than one biasing mechanism.

Figure 14:
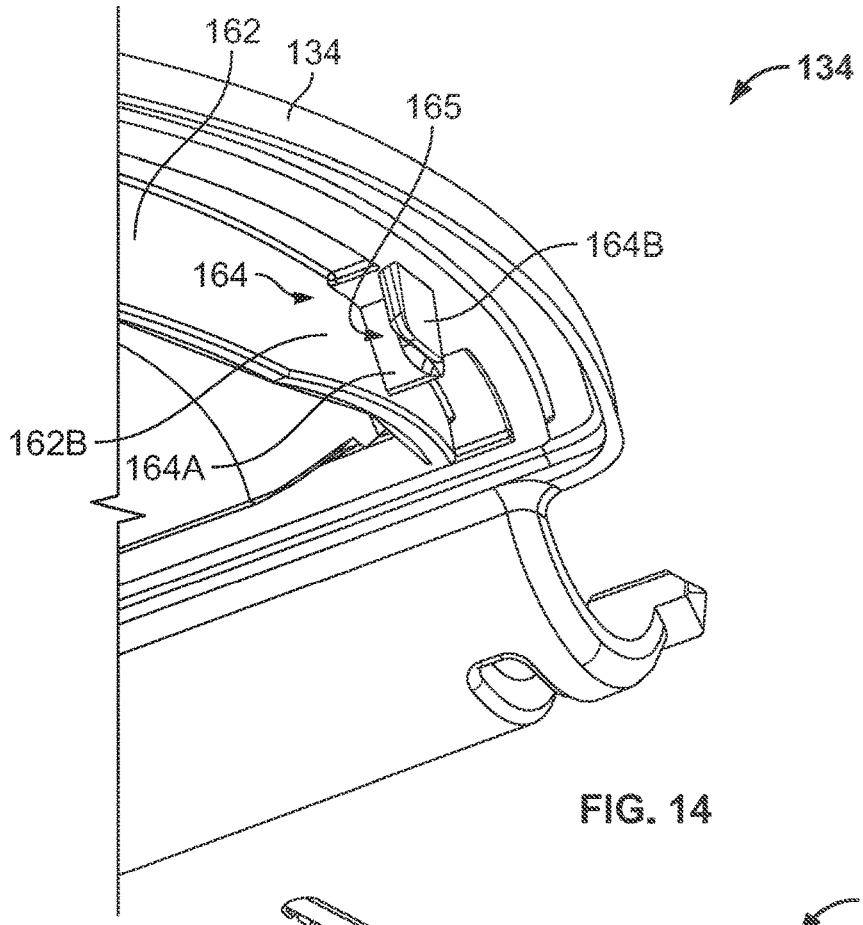
FIG. 14 is a fragmentary, rear perspective view of the filter access door of FIG. 7.
Figure 17:
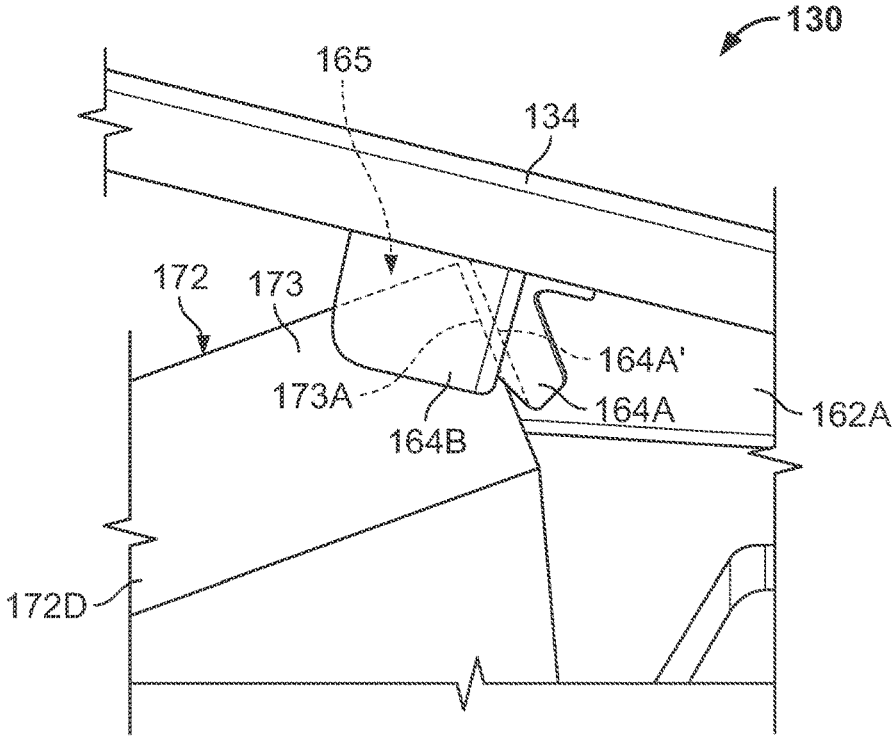
FIG. 17 is an enlarged, fragmentary view of the debris bin configured as shown in FIG. 16.

With reference to FIGS. 14 and 17, each interlock feature 164 includes a portion 162B of the flange 162, an end wall 164A, and an outer side wall 164B. The end wall 164A extends laterally outward from the flange portion 162B and depends downwardly or inwardly from the door 134. The outer side wall 164B extends rearwardly (with respect to the support structure 102) from the end wall 164A. The walls 162B, 164A, 164B collectively define an interlock socket or slot 165. The interlock slot 165 is open from the rear and below.

The bin retention system 180 includes the handle latch portions 184 and two opposed latch assemblies 186A, 186B (FIGS. 3 and 18). The latch portion 184 on the right side of the bin 130 and the latch assembly 186A cooperatively form a right side latch mechanism 182A. The latch portion 184 on the left side of the bin 130 and the latch assembly 186B cooperatively form an opposing left side latch mechanism 182B. The bin retention mechanism 180 serves to retain the debris bin 130 in the seating 120 unless and until an operator chooses to remove the bin 130. The bin retention system 180 can then be operated to selectively release the bin 130 from the support structure 102 to permit the bin 130 to be removed from the seating 120.

Each latch assembly 186A, 186B includes a latch member 187 and a biasing mechanism 188. In some embodiments and as shown, each biasing mechanism is a spring 188 and each latch number 187 is spring loaded. The springs 188 may be torsion springs, for example. However, other types of biasing mechanisms or springs may be used.

Each latch member 187 includes a pivot end 187B and an opposing distal or free end 187C. An integral engagement or latch portion or tab 183 projects laterally from the free end 187C. The latch tab 183 has a chamfered or rounded end face 183A. The end face 183A is rounded on its upper edge 183B and has a relatively sharp cornered lower edge 183D.

Each latch member 187 is mounted in the support structure 102 such it pivots about its pivot end 187B and the latch tab 183 projects through a hole 189 (FIG. 18) in the side wall 114 into the seating 120. The associated spring 188 biases or loads the latch tab 183 into the seating 120 in an inward direction J (FIG. 23). However, the associated spring 188 permits the latch tab 183 to be depressed or displaced in an outward direction K along a latch axis M-M (FIG. 23) into the corresponding hole 189.

The mobile cleaning robot 100 may be used as follows to execute cleaning of a surface. The operation of the robot 100 will first be described with the filter unit 150 installed in the bin 130, and the bin 130 installed in the seating 120. Methods for installing the filter unit 150 in the bin 130 and removing the filter unit 150 from the bin 130 are discussed below. Methods for installing the bin 130 in the support structure 102 and removing the bin 130 from the support structure 102 are also discussed below.

The bin 130 is fully seated in the seating 120. The bin access panel 112 covers the debris bin 130 and is secured in the closed position by the latch features 134C. In some implementations, the robot 100 is configured such that when the bin access panel 112 is ajar or when the debris bin 130 is not present or properly positioned in the seating 120, the mobile cleaning robot 100 will not perform cleaning operations (e.g., autonomous vacuuming). In some implementations, the robot 100 is configured such the bin access panel 112 cannot be closed when the debris bin 130 improperly seated in the seating 120. As discussed below, the bin 130 is mechanically secured in the seating 120 by the bin retention mechanism 180.

The filter unit 150 is positioned in the filter loading seat 171 and the arms 172 are in the retracted position. The filter access door 134 is closed over the filter unit 150 and secured closed by the latch features 134C. The filter unit 150 is thereby positioned on the ledge 166 in the second volume 140U and between the filter access door 134 and the internal barrier 137.

FIG. 5 is a schematic side view cutaway of the mobile cleaning robot 100 showing placement of the debris bin 130 within the mobile robot 100 and the path of an airflow FP through the mobile robot 100 as indicated by a dashed line.

During operation, the debris bin 130 is disposed in the airflow path FP and the blower 118 pulls air through the debris bin 130. The blower 118 pulls air through the cleaning head 108 and the bin 130 to create a negative pressure (e.g., vacuum pressure effect) on a cleaning surface that is proximate to the cleaning head 108. In some implementations, the airflow FP is a pneumatic airflow. The air of the airflow FP carries debris and dirt into the debris bin 130 from the cleaning surface. The air is cleaned by the filter unit 150 disposed in the bin 130, through which the airflow path FP proceeds during operation of the mobile cleaning robot 100. Clean air is expelled through the vent 126.

The airflow FP path proceeds sequentially from the cleaning head 108, through the debris intake duct 122, through the intake port 142, and into the debris bin 130 through the intake port 142. The airflow path FP continues from the intake port 142 into the first volume 140L, through the filter unit 150 from the first volume 140L into the second volume 140U. The airflow path FP proceeds from the second volume 140U, through the bin exhaust port 144, through the exhaust port 118A, through the blower 118, and is then expelled from the mobile cleaning robot 100 through the vent 126.

The debris bin 130 thereby receives debris carried by the airflow FP. The air is filtered by the filter unit 150 so that cleaned air passes through the filter unit 150 into the second containment volume 140U, and debris removed from the air is retained in the first containment volume 140L on the adjacent side of the filter media 156 and/or deposited in the first containment volume 140L. The first containment volume 140L stores dust and debris collected by the mobile cleaning robot 100 during operation (e.g., cleaning operations).

The shape of the first volume 140L determines how the first volume 140L fills with debris during operation. In some implementations, the shape of the first volume 140L, defined partly by the internal barrier 137, causes the first volume 140L to backfill with debris during operation of the mobile cleaning robot 100. The airflow carries debris into the first volume 140L through the intake port 142. As the air is sucked through the filter unit 150 into the second volume 140U, the debris inside the first volume 140L does not pass through the internal barrier 137. In some implementations, the internal barrier 137 pushes heavier debris toward the bottom wall 132 of the bin 130 and away from the filter unit 150 as more air flows in through the intake port 142 and through the filter unit 150.

The ledge 166 of the internal barrier 137 supports and retains the installed filter unit 150 in the airflow path. The aperture 141 is smaller in each dimension than the filter unit 150 so that the filter unit 150 fully covers the aperture 141. The filter unit 150 is held in place against the internal barrier 137 by the filter door 134. The filter unit 150 is thereby secured such that the airflow caused by the blower 118 during cleaning operations of the mobile cleaning robot 100 does not shift the filter unit 150 out of place or unseat the filter within the second volume 140U.

The bin housing 131 may include guide features or structures that extend into the subchamber 140U to guide and secure the filter unit 150 in the filter seat 143. The guide structures may be ramped or wedge-shaped protrusions, for example.

In some implementations, the filter door 134 includes guide features or structures that extend down from the filter door and press against the filter unit 150 to further secure the filter unit 150 in place when the filter door 134 is secured in a closed position. The structures can be a molded portion of the filter door 134.

If the filter unit 150 is unseated from the internal barrier 137 during cleaning operations, airflow may bypass the filter unit 150 though a gap between the filter unit and the internal barrier 137 and allow debris to enter the second volume 140U and the blower 118.

The filter unit 150 is removably disposed in the bin 130. During initial set up of the robot 100 and/or thereafter it may be necessary or desirable to place, remove or replace the filter unit 150 in the bin 130. To this end, the filter access door 134 can be opened and the filter unit 150 can be removed as described below. The filter removal procedure can be executed with the bin 130 removed from the support structure 102, or with the bin 130 installed in the seating 120 and the bin access door 134 open. The filter unit 150 can be removed, cleaned of dust and debris, and reinstalled in the bin 130, or the filter unit 150 can be replaced in the bin 130 with a new filter unit 150.

The filter unit 150 can be accessed and handled as follows. For the purpose of description, the bin 130 is initially in the closed position with the door 134 closed and the filter unit 150 mounted in the installed filter seat 143 as shown in FIGS. 5 and 7. The closed door 134 holds the filter unit 150 and the arms 172 down against the biasing load of the springs 176. In some embodiments, the rear, laterally extending leg of the flange 162 presses on the rear end of the filter unit 150 as shown in FIG. 12.

The filter access door 134 is then opened. When the door 134 is opened, the springs 176 force the arms 172 to automatically pivot in direction N (FIG. 11) about the hinges H1 into the extended position (FIGS. 9-11). The filter unit 150, being held in the filter loading seat 171, is thereby likewise raised from an installed position to a raised position. The user can then conveniently grasp the filter unit 150 and lift or slide the filter unit 150 out of the filter loading seat 171. The pull-tab 157 can be used to grasp and remove the filter unit 150 from the bin 130 through the filter door 134.

The arms 172 will remain upright under the force of the springs 176. The user can then place or slide a filter unit 150 (which may be the original filter unit or another filter unit) into the filter loading seat 171. With the arms 172 in their upright position, the filter unit 150 thus supported is disposed in its filter loading position. The user can then push the filter access door 134 closed in a closing direction P (FIG. 11). As the door 134 pivots closed, the door 134 (the flange 162 and/or the body panel 134B) contacts an upper, front end leading edge 150E of the filter unit 150 (e.g., the top edge of the frame rail 152C) and transfers the closing force to the filter unit 150 at that engagement. The closing force is thereby transferred to the arms 172 via the filter unit 150, causing the arms 172 to pivot downward (against the continuing load of the springs 176) in a direction Q (FIG. 11) toward the retracted position as the door 134 is closed. The door 134 remains in contact with the filter unit 150 and is pivoted down in this manner until it is fully closed and latched, at which time the engagement between the door 134 and the filter unit 150 has forced the filter unit 150 into its fully installed position on the installed filter seat 143.

In the event that the filter unit 150 is not fully seated in the filter loading seat 171, the closing door 134 may push the filter unit 150 down into its fully inserted position on the filter loading seat 171. As the door 134 is closed and the filter unit 150 and arms 172 are pivoted down, the lower end of the filter unit 150 is forced into a slot defined below the top wall 133. In this way, the filter unit 150 is accurately positioned and secured in the installed filter seat 143 and relative to the aperture 141.

Notably, as the door 134 is pivoted closed, the engagement between the filter unit 150 and the door 134 ensures that the interlock features 164 do not engage and interlock with the arms 172. That is, the arms 172 are pushed downward at a rate that prevents interference between the ends of the arms 172 and the interlock features 164.

If the robot 100 is operated with the filter unit 150 missing from the bin 130, the airflow FP will not be properly cleaned and may damage the blower 118. It is therefore important to ensure that the filter unit 150 is properly installed before operating the robot 100. The filter presence system 160 provides a robust and effective mechanism for this purpose.

Figure 15:
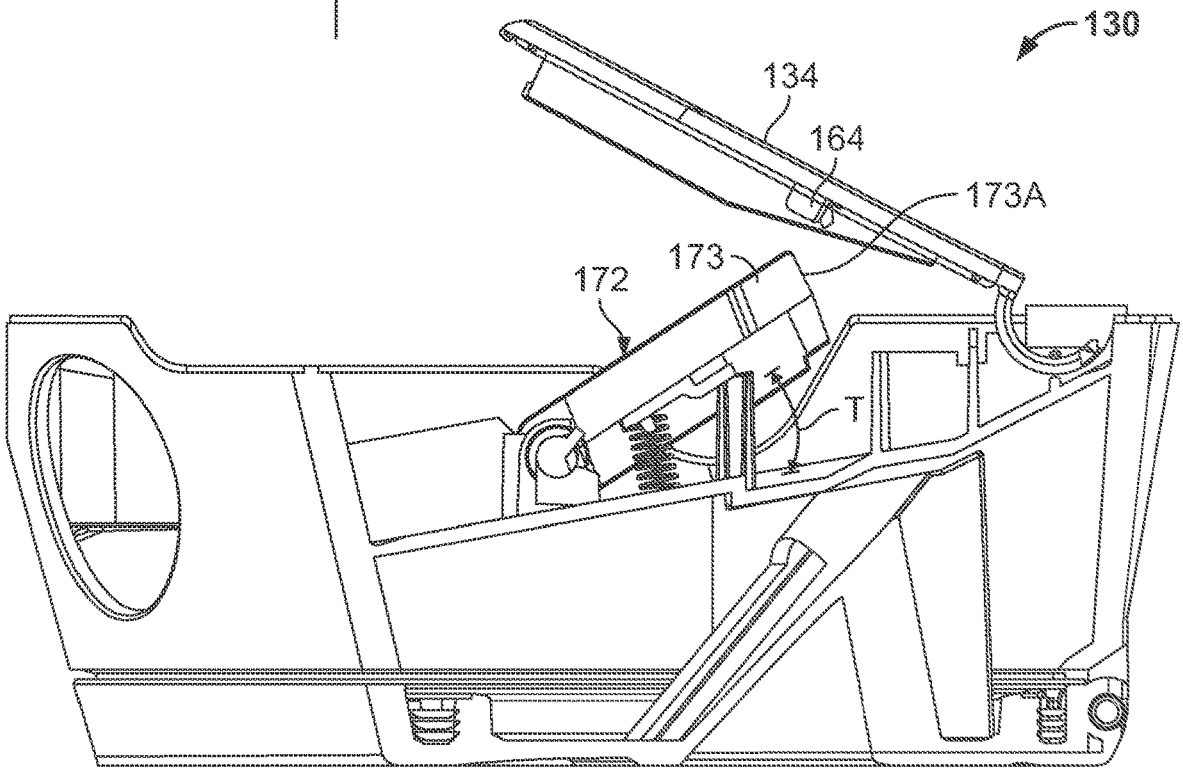
FIG. 15 is a cross-sectional view of the debris bin of FIG. 4, wherein the filter unit is not in the debris bin and the filter access door is open.

When the filter access door 134 is open without a filter unit 150 in the filter loading seat 171, the arms 172 will remain upright under the force of the springs 176, as shown in FIGS. 13 and 15. As the door 134 is rotated from the open position toward the closed position, the lower section 162A of the flange 162 will pass between the arms 172 and into the recesses 174. The stop wall 173 of each arm 172 will enter the slot 165 of the corresponding interlock feature 164.

Figure 16:
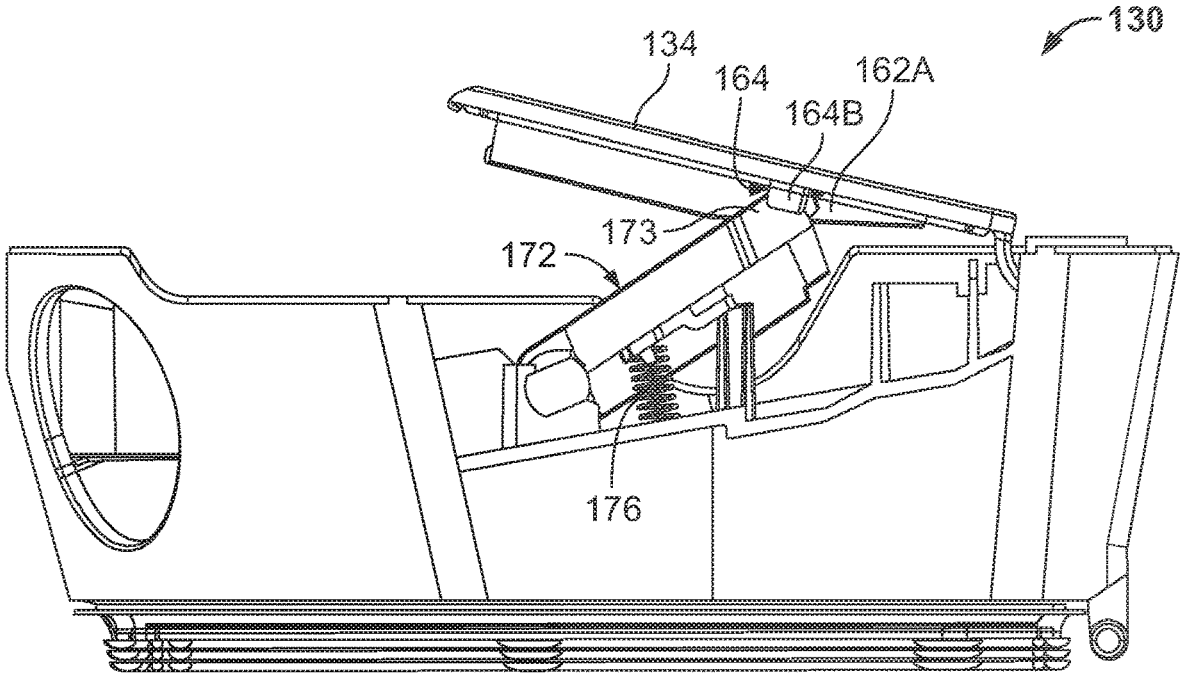
FIG. 16 is a cross-sectional view of the debris bin of FIG. 4, wherein the filter unit is not in the debris bin and the filter access door is locked open by a filter presence system forming a part of the debris bin.

As the door 134 is further rotated toward the closed position, the stop wall 173 of each upstanding arm 172 is further received in its respective slot 165 until the terminal edge 173A abuts the end wall 164A, as shown in FIGS. 16 and 17. In some embodiments, the terminal edge 173A is substantially parallel with the abutting face 164A' of the end wall 164A so that the terminal edge 173A fits substantially squarely with the end wall 164A.

The stop walls 173 are thereby interlocked with the interlock features 164 to limit or prevent further pivoting of the door 134 toward the closed position. The cover 134 is retained in a locked open position and the filter presence system 160 has assumed a lockout position. The stop wall 173 in slot 165 arrangement of each arm interlock provides lateral stability to each arm 172 to ensure that the ends of the arms do not become disengaged from the features 164.

As a result, the door 134 cannot be fully closed, and the user is thus notified that the filter unit 150 should be installed. The inability and failure of the door 134 to close completely provides visual and tactile feedback to the user indicating that the filter unit 150 is not installed.

Moreover, the bin access door 112 cannot be fully closed over the bin 130 with the door 134 not fully closed. In some embodiments, the robot 100 is configured such that the blower 118 will not operate when the door 112 is not closed. In some embodiments, the bin access door 112 must be closed to make contact with an electrical contact on the support structure, and the robot 100 may visually or audibly indicate an error to the user in the event an attempt to run the blower 118 is made while the bin access door 112 is open. Because the filter access door 134 cannot close, the bin access door 112 cannot close, and the robot 110 therefore cannot be run without the filter unit 150 probably installed.

In some embodiments, the relative positions, angles, orientations and/or geometries of the cover 134, interlock features 164, recesses 174, stop walls 173, and arms 172 are selected such that the arms 172 mechanically prevent or resist displacement of the cover 134 beyond the locked open position. In some embodiments, these components are arranged such that the force vector of the closing cover 134 tends to hold the arms 172 at their original angle or to raise the arms 172 further, and does not tend to force the arms 172 to pivot downward.

The user can rotate the filter access cover 134 back away from the arms, and load the filter unit 150 into the filter loading seat 171. The user can then close the door 134 as described above.

Figure 8:
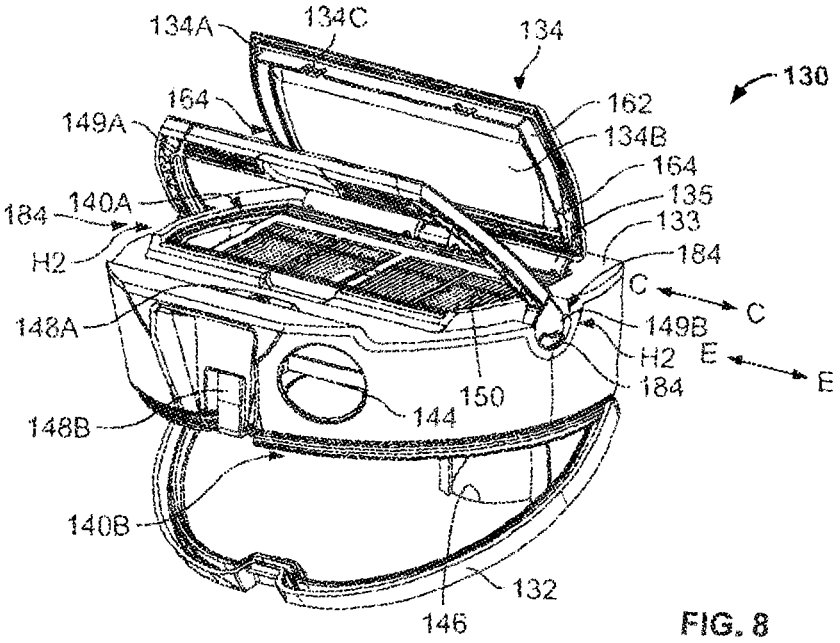
FIG. 8 is a rear perspective view of the debris bin of FIG. 4, wherein the filter access door is in an open position, a handle forming a part of the debris bin is in a partially raised position, a bottom panel forming a part of the debris bin is in an open position, and the filter unit is positioned in an installed filter seat of the debris bin.

The arms 172 are pivoted through an angle T (FIG. 15) from their raised position (FIG. 15) to their retracted position (FIG. 8). In some embodiments, the angle T is at least 23 degrees.

In some embodiments, the filter unit 150 is disposed at an angle with respect to horizontal when fully installed in the installed filter seat 143. In some embodiments, the filter unit 150 is disposed at an angle relative to horizontal in the range of from about 20 to 26 degrees.

The debris bin 130 is removable from the mobile cleaning robot 100, for example, to be emptied of debris by a user, cleaned, and/or replaced. However, it is important that the bin 130 be properly seated in the seating 120 when the blower 118 is running in order to ensure that the air flow ports and passages are mated and aligned as prescribed. Also, the bin 130 should be retained in the seating 130 until deliberately removed by the user. The bin 130 should not become dislodged from the seating inadvertently if the robot 100 is turned upside-down, for example.

The bin retention system 180 serves to secure the bin 130 in the seating 120. The bin retention system 180 also enables an operator to selectively remove the bin 130 from the seating 120 and replace and secure the bin 130 (or another debris bin 130) in the seating 120.

In use, the bin 130 is inserted into the seating 120 in an insertion direction I (FIG. 5), as discussed above. The bin 130 is oriented such that the latch portions 184 of the handle 149 align with the latch tabs 183 of the latch assemblies 186A and 186B, respectively. This alignment may be accomplished deliberately by the user and/or by the mechanical centering provided by the cooperating geometries of the bin 130 and the seating 120.

The handle 149 may be in either a raised position or a retracted position when the bin is being inserted into the seating 120. In either case, the latch tabs 183 will slide along the bin sidewall 138 and over the handle latch portions 184. The girth and contours of the bin sidewall 138 may depress the latch members 187 outwardly to ease entry of the bin 130, but the springs 188 continue to exert a return force. The rounded upper edges 183B facilitate the passage of the latch tabs 183 over the sidewall 138 and latch portions 184. If the handle 149 is in the retracted position, each latch tab 183 is forced into the space or socket 185D above the land 185A, thereby latching the bin 130 in the seating 120. If the handle 149 is in the raised position, each latch tab 183 is forced into the socket 185D or onto the ramp 185B. The handle 149 is then lowered into the retracted position, causing the latch tab 183 to slide along the ramp 185A and then drop into the socket 185D above the land 185A, thereby latching the bin 130 in the seating 120.

Figure 20:
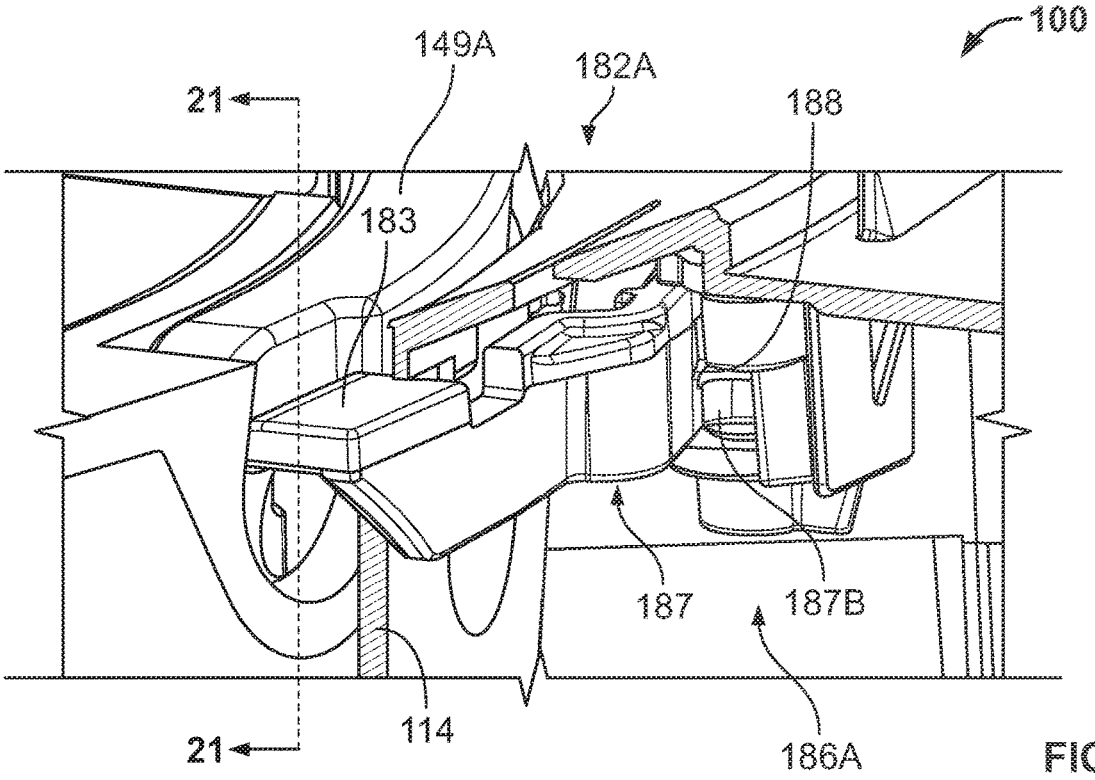
FIG. 20 is a fragmentary, perspective view of the latch mechanism of FIG. 18 in a latched position.

With the bin 130 fully seated and the handle 149 in the retracted or stored position, each latch tab 183 extends laterally into the corresponding socket 185D and is retained in this position by the biasing load of the spring 188. The latch mechanisms 182A, 182B are in their locking positions, as shown in FIGS. 20 and 21. In the event a force is applied to the bin 130 tending to displace the bin 130 from the seating 120 (i.e., a force along the axis A-A in a removal direction R (FIGS. 5 and 21)), each latch tab 183 will engage and interlock with the land 185A of its corresponding handle latch portion 184. As a result, the bin 130 is prevented or inhibited by the interlocks between the lands 185A and the latch tabs 183 from being displaced from the seating 120. In some embodiments, the handle body 149A is oriented substantially horizontal when the handle 149 is in its stored position.

The components of the bin retention system 180 are configured such that a force exerted on the raised handle 149 in the removal direction R primarily results in vertical lifting forces on the latch tabs 183 and not laterally directed forces that would push the latch tabs 183 outwardly (direction K) along the axes M-M.

The bin 130 may thereafter be removed or withdrawn from the seating 120 as follows. The user rotates the handle 149 in the direction F from the retracted position to the raised position. As the handle 149 is rotated, each latch portion 184 is correspondingly rotated in the direction F relative to its latch tab 183. The interaction between each latch portion 184 and latch assembly 186A, 186B pair will be described below with reference to the latch mechanism 182A as shown in FIGS. 18-23. However, it will be appreciated that this description likewise applies to the latch mechanism 182B. In some embodiments, the handle body 149A is oriented substantially vertical when the handle 149 is in the raised position.

FIGS. 20 and 21 show the bin 130 seated in the seating 120, the handle 149 in the retracted position, and the latch mechanism 182A in the locking position. As discussed above, the latch tab 183 is laterally extended by the spring 188 and seated in the socket 185D.

As the user rotates the handle 149, the latch features 185A, 185B are correspondingly rotated relative to the latch tab 183 about the hinge axis E-E. The flat 185A is relocated and reoriented so that it no longer locks the latch tab 183 in place. The leading edge 185C of the ramp 185B slides to a position under the latch tab 183 along the removal axis R. The latch mechanism 182A is thereby placed in a releasing position.

With the latch mechanism 182A in the releasing position, the user then lifts the bin 130 in the removal direction R out of the seating 120.

As the bin 120 is removed, the ramp 185B progressively pushes the latch tab 183 outwardly against the force of the spring 188. The latch tab 183 is thereby forcibly translated, depressed or displaced in the direction K into the hole 189. The ramp 185B holds the latch tab 183 in the depressed position, enabling the latch tab 183 to slide over the handle 149 and onto the bin sidewall 138. The latch tab 183 can then slide along the bin sidewall 138 until the bin 130 is clear of the seating 120.

The latch feature 185B will displace the latch tab 183 outward a displacement distance V sufficient for the latch tab 183 to slide over the edge 138A of the bin 130 below the latch portion 184 without undue effort. In some embodiments, the latch tab 183 is displaced in this manner such that the end face 183A of the latch tab 183 is laterally clear or nearly clear of the edge 138A.

In some embodiments and as shown in FIGS. 18-23, the ramp 185B (or other latch feature(s) on the handle latch portion 184) is configured to not displace the latch tab 183 outward when the bin 130 is fully seated and the handle 149 is fully raised, the latch mechanism 182A being in the releasing position. In this case, the leading edge 185C is positioned below and adjacent the lower edge of the latch tab 183. The latch tab 183 is then displaced the full distance V as the bin 130 is lifted out and the latch tab 183 slides down the ramp 185B (which increases in height).

In other embodiments, the ramp 185B (or other latch feature(s) on the handle latch portion 184) is configured to operate as a cam. As the user rotates the handle 149, the leading edge 185C of the ramp 185B slides under the latch tab 183 and between the latch tab 183 and the interior of the bin 130. The ramp 185B thereby progressively pushes the latch tab 183 outwardly against the force of the spring 188 in the direction K and holds the latch tab 183 in a depressed position when the latch mechanism 182A is in the releasing position and the bin 130 is still seated in the seating 120.

In some embodiments where the ramp 185B (or other latch feature(s) on the handle latch portion 184) is configured to operate as a cam, the ramp 185B forces the latch tab 183 only a portion of the distance V when the bin 130 is fully seated and the handle is fully raised, placing the latch mechanism 182A in the releasing position. The latch tab 183 is then displaced the remainder of the distance V as the bin 130 is lifted out and the latch tab 183 slides down the ramp 185B.

In other embodiments where the ramp 185B (or other latch feature(s) on the handle latch portion 184) is configured to operate as a cam, the ramp 185B forces the latch tab 183 the full distance V when the bin 130 is fully seated and the handle is fully raised, placing the latch mechanism 182A in the releasing position.

Once the bin 130 has been removed, the latch tab 183 is free to return to the extended position urged by the spring 188. The bin 130 (or another debris bin) can thereafter be installed in the seating as described above.

The robot 100 may further include a bin detection system for sensing an amount of debris present in the debris bin 130 (e.g., as described in U.S. Patent Publication 2012/0291809, the entirety of which is hereby incorporated by reference).

In some implementations, the bin 130 is formed to fit in the seating 120 within a tolerance (in some embodiments, 0 mm to 5 mm). The tolerance ensures that the one or more ports of the debris bin 130 align with other features of the mobile cleaning robot 100 without adversely affecting airflow or allowing air leaks, as described below.

The bin 130 may be formed of any suitable material(s). Suitable materials may include rigid polymeric materials (e.g., plastic).

In some implementations, the bin 130 includes a transparent portion for viewing the containment volume 140L to determine if the bin 130 requires emptying. In some implementations, one or more sensors placed within the debris bin 130 or at the opening of the debris bin 130 detect an approximate amount of debris in the debris bin 130 and send an alert to the mobile cleaning robot 100 that the bin 130 is in need of evacuation or emptying before proceeding with further operation (e.g., further vacuuming).

One or more bin sensors, such as optical sensors, can be used to measure approximately how much debris is accumulating in the first volume 140L, and when the first volume 140L is full of debris and should be emptied. A signal can be sent from the bin full sensor indicating this measurement to a controller or processor of the mobile cleaning robot 100. In some implementations, the controller 198 can generate instructions to cease cleaning operations and cause the mobile cleaning robot 100 to navigate to an external evacuation device. In some implementations, the controller can generate a measurement on a graphical user interface of the mobile cleaning robot 100 or an associated remote device in communication with the mobile cleaning robot 100, send an alert to a remote device, cause a beacon to light, or otherwise indicate to a user that the bin 130 of the mobile cleaning robot 100 should be emptied.

In some implementations, a bin access door position sensor 117A is provided to indicate whether the bin access door 112 is closed or not. For example, the bin access door position sensor 117A may be one or more electrical contacts on the robot 100 that are engaged or actuated by contact with one or more contacts or features 117B on the bin access door 112 when the door 112 is closed. A signal from or actuation of the bin door position sensor 117A can be used by a controller of the mobile cleaning robot 100 (e.g., the onboard controller 198) to determine whether the bin access door 112 is closed. If the bin access door 112 is not closed during a cleaning operation, the controller 198 will prevent the mobile cleaning robot 100 from operating at least certain components, subsystems or functions. In particular, the controller 198 may prevent at least the blower 118 (and, in some embodiments, at least the blower 118 and the drive system 194) from running even when a command is received (e.g., a command that is manually input via an HMI on the robot 100, a command received via a remote application, or a command issued from an automatic scheduling routine). The controller 198 may actuate or send a signal or alert to the user indicating that there is an error associated with the bin 130. Prompted by the alert, the user can inspect the robot 100 and ascertain the cause of the error (i.e., why the bin access door 112 is not closed). The user may determine that the bin 130 is not properly positioned or configured, and can reconfigure the bin 130 and close the bin access door 112 to enable the robot 100 to continue the cleaning operation.

Thus, the bin access door position sensor 117A and the filter presence system 160 can cooperatively prevent undesirable operation of the robot 100 in the event a filter unit 150 is not properly positioned in the bin 130. In that case, the filter presence system 160 will prevent the filter access door 134 from assuming its closed position, which will prevent the bin access door 112 from being placed in its closed position over the nonclosed bin 130 in the seating 120. This in turn will cause the bin access door position sensor 117A to indicate that the bin access door 112 is not properly positioned (i.e., it is not closed). With the robot 100 in this state, the controller 198 will prevent the robot 100 from operating at least certain subsystems or functions and may issue an alert, as discussed above.

In some implementations, a bin presence sensor 115A is mounted in the bin access door 112 with a cooperating feature or component 115B being mounted in or on the bin 130. In some embodiments, the bin presence sensor 115A is a Hall Effect sensor and the component 115B is a magnet. A signal from the bin presence sensor 115A can be used by a controller (e.g., the onboard controller 198) to determine whether the debris bin 130 is present inside the mobile cleaning robot 100. If the debris bin 130 is not present in the bin seating 120 or is not properly positioned with the filter access door 134 closed during the cleaning operation, the controller 198 of the mobile cleaning robot 100 will prevent the mobile cleaning robot 100 from operating at least certain subsystems or functions as discussed above with regard to the sensor 117A. The controller 198 may actuate or send a signal or alert to the user indicating that there is an error associated with the bin 130 as discussed above with regard to the sensor 117A.

The robots described herein can be controlled, at least in part, using one or more computer program products, e.g., one or more computer programs tangibly embodied in one or more information carriers, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment.

Operations associated with controlling the robots described herein can be performed by one or more programmable processors executing one or more computer programs to perform the functions described herein. Control over all or part of the robots and evacuation stations described herein can be implemented using special purpose logic circuitry, e.g., an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass PCBs for storing data, e.g., magnetic, magneto-optical disks, or optical disks. Machine-readable storage media suitable for embodying computer program instructions and data include all forms of non-volatile storage area, including by way of example, semiconductor storage area devices, e.g., EPROM, EEPROM, and flash storage area devices; magnetic disks, e.g., internal hard disks or removable disks; magneto-optical disks; and CD-ROM and DVD-ROM disks.

In some embodiments, the robot 100 uses a variety of behavioral modes to effectively vacuum a working area. Behavioral modes are layers of control systems that can be operated in parallel. The robot controller 198 (e.g., microprocessor) is operative to execute a prioritized arbitration scheme to identify and implement one or more dominant behavioral modes for any given scenario, based upon inputs from the sensor system. The robot controller 198 may also be operative to coordinate avoidance, homing, and docking maneuvers with a dock.

Generally, the behavioral modes for the described robot 100 can be characterized as: (1) coverage behavioral modes; (2) escape behavioral modes, and (3) safety behavioral modes. Coverage behavioral modes are primarily designed to allow the robot 100 to perform its operations in an efficient and effective manner, while the escape and safety behavioral modes are priority behavioral modes implemented when a signal from the guidance system indicates that normal operation of the robot 100 is impaired (e.g., obstacle encountered), or is likely to be impaired (e.g., drop-off detected).

Representative and illustrative coverage behavioral modes (for vacuuming) for the robot 100 include: (1) a Spot Coverage pattern; (2) an Obstacle-Following (or Edge-Cleaning) Coverage pattern, and (3) a Room Coverage pattern. The Spot Coverage pattern causes the robot 100 to clean a limited area within the defined working area, e.g., a high-traffic area. In a certain embodiments the Spot Coverage pattern is implemented by means of a spiral algorithm (but other types of self-bounded area algorithms, such as polygonal, can be used). The spiral algorithm, which causes outward or inward spiraling movement of the robot 100, is implemented by control signals from the microprocessor to the motive system to change the turn radius/radii thereof as a function of time or distance traveled (thereby increasing/decreasing the spiral movement pattern of the robot 100).

The foregoing description of typical behavioral modes for the robot 100 are intended to be representative of the types of operating modes that can be implemented by the robot 100. One skilled in the art will appreciate that the behavioral modes described above can be implemented in other combinations and other modes can be defined to achieve a desired result in a particular application.

A navigational control system may be used advantageously in combination with the robot 100 to enhance the cleaning efficiency thereof, by adding a deterministic component (in the form of a control signal that controls the movement of the robot 100) to the motion algorithms, including random motion, autonomously implemented by the robot 100. The navigational control system operates under the direction of a navigation control algorithm. The navigation control algorithm includes a definition of a predetermined triggering event.

Broadly described, the navigational control system, under the direction of the navigation control algorithm, monitors the movement activity of the robot 100. In one embodiment, the monitored movement activity is defined in terms of the "position history" of the robot 100, as described in further detail below. In another embodiment, the monitored movement activity is defined in terms of the "instantaneous position" of the robot 100.

The predetermined triggering event is a specific occurrence or condition in the movement activity of the robot 100. Upon the realization of the predetermined triggering event, the navigational control system operates to generate and communicate a control signal to the robot 100. In response to the control signal, the robot 100 operates to implement or execute a conduct prescribed by the control signal, i.e., the prescribed conduct. This prescribed conduct represents a deterministic component of the movement activity of the robot 100.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

What is claimed is:

1. A mobile cleaning robot comprising:

a bin seating;

a drive system operative to move the mobile cleaning robot;

a blower to generate a supply air flow;

a debris bin removably and replaceably disposed in the bin seating, the debris bin including a handle pivotable between a stored position and a raised position;

a filter unit disposed in the debris bin and in a path of the supply air flow; and a bin retention system to retain the debris bin in the bin seating, the bin retention system including a latch mechanism selectively movable between a locking position, wherein the latch mechanism prevents displacement of the debris bin from the bin seating, and a releasing position, wherein the latch mechanism permits displacement of the debris bin from the bin seating, and wherein the bin retention system is transitioned from the locking position to the releasing position by pivoting the handle from the stored position to the raised position.

2. The mobile cleaning robot of claim 1 wherein:

the handle includes a handle body configured to be grasped by a user;

the handle body is oriented substantially horizontal when the handle is in the stored position; and the handle body is oriented substantially vertical when the handle is in the raised position.

3. The mobile cleaning robot of claim 1 wherein the mobile cleaning robot includes a support structure and the bin retention system includes:

a latch portion on the handle; and a latch member on the support structure, the latch member being displaceable relative to the bin seating;

wherein the latch portion engages the latch member and is movable with the handle such that:

when the handle is in the stored position, the latch portion interlocks with the latch member to prevent displacement of the debris bin from the bin seating; and when the handle is transitioned from the stored position to the raised position and the debris bin is lifted from the bin seating, the latch portion displaces the latch member relative to the bin seating to permit displacement of the debris bin from the bin seating.

4. The mobile cleaning robot of claim 3 wherein the latch portion includes a cam feature that displaces the latch member as the handle is transitioned from the stored position to the raised position.

5. The mobile cleaning robot of claim 4 wherein the latch member is spring loaded.

6. The mobile cleaning robot of claim 3 wherein the latch member includes a rounded engagement end that contacts the latch portion as the debris bin is inserted into the bin seating.

7. The mobile cleaning robot of claim 1 including:

a filter seat;

a filter access opening;

a filter access door pivotable between a closed position, wherein the filter access door covers the filter access opening, and an open position, wherein the filter access door is displaced from the filter access opening to permit access to the filter seat; and a filter presence system configured to:

permit the filter access door to move from the open position into the closed position when the filter unit is disposed in the filter seat; and prevent the filter access door from being moved into the closed position when the filter unit is not disposed in the filter seat.

8. A mobile cleaning robot comprising:

a bin seating;

a drive system operative to move the mobile cleaning robot;

a blower to generate a supply air flow;

a debris bin removably locatable in the bin seating, the debris bin including a handle movable between a stored position and a raised position;

a filter unit located in the debris bin and in a path of the supply air flow; and a bin retention system to retain the debris bin in the bin seating, the bin retention system including a latch mechanism selectively movable between a locking position, wherein the latch mechanism prevents displacement of the debris bin from the bin seating, and between a releasing position, wherein the latch mechanism permits displacement of the debris bin from the bin seating, and the bin retention system configured to transition from the locking position to the releasing when the handle is moved from the stored position to the raised position.

9. The mobile cleaning robot of claim 8 wherein:

the handle includes a handle body configured to be grasped by a user;

the handle body is oriented substantially horizontal when the handle is in the stored position; and the handle body is oriented substantially vertical when the handle is in the raised position.

10. The mobile cleaning robot of claim 8 wherein the mobile cleaning robot includes a support structure and the bin retention system includes:

a latch portion on the handle; and a latch member on the support structure, the latch member being displaceable relative to the bin seating.

11. The mobile cleaning robot of claim 10 wherein the latch portion engages the latch member and is movable with the handle such that:

when the handle is in the stored position, the latch portion interlocks with the latch member to prevent displacement of the debris bin from the bin seating; and when the handle is transitioned from the stored position to the raised position and the debris bin is lifted from the bin seating, the latch portion displaces the latch member relative to the bin seating to permit displacement of the debris bin from the bin seating.

12. The mobile cleaning robot of claim 11 wherein the latch portion includes a cam feature that displaces the latch member as the handle is transitioned from the stored position to the raised position.

13. The mobile cleaning robot of claim 12 wherein the latch member is spring loaded.

14. The mobile cleaning robot of claim 11 wherein the latch member includes a rounded engagement end that contacts the latch portion as the debris bin is inserted into the bin seating.

15. A mobile cleaning robot comprising:

a bin seating;

a blower operable to generate a supply air flow;

a debris bin removably locatable in the bin seating, the debris bin including a handle movable between a stored position and a raised position;

a filter unit located in the debris bin and in a path of the supply air flow; and a bin retention system to retain the debris bin in the bin seating, the bin retention system including a latch mechanism selectively movable between a locking position, wherein the latch mechanism limits displacement of the debris bin from the bin seating, and between a releasing position, wherein the latch mechanism permits displacement of the debris bin from the bin seating, and wherein the latch mechanism is configured to transition from the locking position to the releasing position when the handle is moved to the raised position.

16. The mobile cleaning robot of claim 15 including:

a filter seat;

a filter access opening; and a filter access door pivotable between a closed position, wherein the filter access door covers the filter access opening, and an open position, wherein the filter access door is displaced from the filter access opening to permit access to the filter seat.

17. The mobile cleaning robot of claim 16 including:

a filter presence system configured to:

permit the filter access door to move from the open position into the closed position when the filter unit is disposed in the filter seat; and prevent the filter access door from being moved into the closed position when the filter unit is not disposed in the filter seat.

18. The mobile cleaning robot of claim 15 wherein:

the handle includes a handle body configured to be grasped by a user;

the handle body is oriented substantially horizontal when the handle is in the stored position; and the handle body is oriented substantially vertical when the handle is in the raised position.

19. The mobile cleaning robot of claim 15 wherein the mobile cleaning robot includes a support structure and the bin retention system includes:

a latch portion on the handle; and a latch member on the support structure, the latch member being displaceable relative to the bin seating.

20. The mobile cleaning robot of claim 19 wherein the latch portion engages the latch member and is movable with the handle such that:

when the handle is in the stored position, the latch portion interlocks with the latch member to prevent displacement of the debris bin from the bin seating; and when the handle is transitioned from the stored position to the raised position and the debris bin is lifted from the bin seating, the latch portion displaces the latch member relative to the bin seating to permit displacement of the debris bin from the bin seating.

* * * * *